US009818375B2

(12) United States Patent
Sone et al.

(10) Patent No.: US 9,818,375 B2
(45) Date of Patent: Nov. 14, 2017

(54) LIQUID-CRYSTAL DISPLAY DEVICE AND DRIVE METHOD THEREOF

(71) Applicant: Sharp Kabushiki Kaisha, Osaka-shi, Osaka (JP)

(72) Inventors: Takuya Sone, Osaka (JP); Noriyuki Tanaka, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 143 days.

(21) Appl. No.: 14/431,819

(22) PCT Filed: Aug. 9, 2013

(86) PCT No.: PCT/JP2013/071615
§ 371 (c)(1),
(2) Date: Mar. 27, 2015

(87) PCT Pub. No.: WO2014/050327
PCT Pub. Date: Apr. 3, 2014

(65) Prior Publication Data

US 2015/0243253 A1 Aug. 27, 2015

(30) Foreign Application Priority Data

Sep. 28, 2012 (JP) ..... 2012-217381

(51) Int. Cl.
*G09G 5/18* (2006.01)
*G09G 3/36* (2006.01)
*G09G 3/20* (2006.01)

(52) U.S. Cl.
CPC ..... *G09G 5/18* (2013.01); *G09G 3/2096* (2013.01); *G09G 3/3611* (2013.01); (Continued)

(58) Field of Classification Search
CPC ..... G09G 3/00–3/38; G09G 3/2096; G09G 3/3611; G09G 5/18; G09G 3/3614; (Continued)

(56) References Cited

U.S. PATENT DOCUMENTS 8,749,541 B2 * 6/2014 Kim ..... G09G 3/20 345/211
9,135,880 B2 * 9/2015 Koyama ..... G09G 3/3688
(Continued)

FOREIGN PATENT DOCUMENTS

JP 2002-278523 A 9/2002
JP 2004-078124 A 3/2004
JP 2011-191746 A 9/2011

OTHER PUBLICATIONS

Office Communication issued in International Patent Application No. PCT/JP2013/071615, dated Oct. 22, 2013.

*Primary Examiner* — Bryan Earles
(74) *Attorney, Agent, or Firm* — Keating & Bennett, LLP

(57) ABSTRACT

Provided are a liquid crystal display device and a drive method thereof, capable of promptly making an afterimage, which is visually recognized during pause drive, visually unrecognizable while suppressing power consumption. When updated image data is transmitted, a first refresh is performed by used of this image data, and a refresh pauses based on Ref_int just in the next two-frame period. Then, the second and third refreshes are consecutively performed, and a refresh pause is repeated until the next updated image data is transmitted. In this case, since a refresh can be performed three times in a short period after reception of the updated image data, it is possible to make liquid crystal molecules oriented in a direction corresponding to an applied voltage in a short time and make an afterimage visually unrecognizable.

8 Claims, 18 Drawing Sheets

(52) U.S. Cl.
CPC ..... *G09G 3/3696* (2013.01); *G09G 3/3614* (2013.01); *G09G 3/3648* (2013.01); *G09G 2310/0278* (2013.01); *G09G 2320/0252* (2013.01); *G09G 2330/021* (2013.01); *G09G 2340/0435* (2013.01); *G09G 2360/18* (2013.01); *G09G 2370/022* (2013.01)

(58) Field of Classification Search
CPC ..... G09G 3/3648; G09G 2310/0278; G09G 2320/0252; G09G 2330/021; G09G 2340/0435; G09G 2360/18; G09G 2370/022
See application file for complete search history.

(56) References Cited

U.S. PATENT DOCUMENTS

| | | | | |
|---|---|---|---|---|
| 2001/0028409 | A1* | 10/2001 | Watanabe | G09G 1/04 348/554 |
| 2002/0093473 | A1* | 7/2002 | Tanaka | G09G 3/3648 345/87 |
| 2003/0020699 | A1* | 1/2003 | Nakatani | G06F 3/1415 345/204 |
| 2004/0036669 | A1 | 2/2004 | Yanagi et al. | |
| 2008/0094383 | A1* | 4/2008 | Stessen | G09G 3/3406 345/209 |
| 2011/0205254 | A1* | 8/2011 | Umezaki | G09G 3/3648 345/690 |
| 2011/0261043 | A1* | 10/2011 | Hayakawa | G09G 3/3696 345/211 |
| 2014/0055476 | A1* | 2/2014 | Wang | G09G 5/003 345/547 |

* cited by examiner (a)

(b)

(c)

HOST
5Hz
DISPLAY PORTION
Ref int
NUMBER OF FRAMES
R N N R R N N N N N N N N N N R N N N N N N N N N N HOST
5Hz
DISPLAY PORTION
Ref int
NUMBER OF FRAMES
R N N N R N N N HOST
5Hz
DISPLAY PORTION
Ref int
NUMBER OF FRAMES
R N N R N N R N N HOST
15Hz
5Hz
15Hz
5Hz
DISPLAY PORTION
Ref int
NUMBER OF FRAMES
R N N R R N N R R N N N 5Hz
15Hz
HOST
DISPLAY PORTION
Ref int
NUMBER OF FRAMES
R N N R R N N R R N N R HOST
5Hz
DISPLAY PORTION
Ref int
NUMBER OF FRAMES
R N N R R N N N N N N N N N N R R N N N N N N N N N N R R N N N N N N N N HOST
5Hz
DISPLAY PORTION
Ref int
NUMBER OF FRAMES
A
B
B
C
R N N R N N N HOST
5Hz
DISPLAY PORTION
Ref int
NUMBER OF FRAMES
R N N R R N N N N N N N N R N N N N N N N N

LIQUID-CRYSTAL DISPLAY DEVICE AND DRIVE METHOD THEREOF

TECHNICAL FIELD

The present invention relates to a liquid crystal display device and a drive method thereof, and specifically relates to a liquid crystal display device that displays an image by pause drive, and a drive method thereof.

BACKGROUND ART

In recent years, small-sized lightweight electronic equipment has been under active development. A liquid crystal display device mounted as a display device in such electronic equipment has been required to consume low electric power. As one of drive methods for reducing power consumption of the liquid crystal display device, there is a drive method called "pause drive" in which a scanning period for scanning scanning lines to refresh a screen is provided and then a pause period (non-refresh period) for bringing all scanning lines into a non-scanning state to make a refresh pause is provided. In this drive method, a controlling signal or the like is not given to a scanning line drive circuit and/or a signal line drive circuit in the pause period. Hence it is possible to make pause operations of the scanning line drive circuit and/or the data signal line drive circuit, so as to attain low power consumption of the liquid crystal display device. Such pause drive is also referred to as "low-frequency drive" or "intermittent drive".

For example, Japanese Patent Application Laid-Open No. 2004-78124 discloses that an operation of a clock signal generation circuit which generates a clock signal for taking a data signal into a signal line is halted, thereby reducing consumption power in a pause period.

PRIOR ART DOCUMENT

Patent Document

[Patent Document 1] Japanese Patent Application Laid-Open No. 2004-78124

SUMMARY OF THE INVENTION

Problems to be Solved by the Invention

In the pause drive, the larger the number of frames in the pause period is made, the more the power consumption can be reduced. For example, when a refresh rate is set to 1 Hz, the number of refresh frames is one and the number of non-refresh frames is 59, thus allowing significant reduction in power consumption. However, due to a reason described later, there occurs a problem that an afterimage is visually recognized for two seconds from the start of the first refresh to the end of the third refresh. As thus described, when the refresh rate is lowered, the number of times of refreshing a screen per unit time decreases, and hence an afterimage is visually recognized for a long time.

A description will be given of the reason why such an afterimage is visually recognized at the pause drive time. First, there will be described a configuration of a pixel formation portion included in a display portion of the liquid crystal display device. Each pixel formation portion is provided with a thin-film transistor that functions as a switching element (Thin-Film Transistor: hereinafter referred to as "TFT"). A source terminal of the TFT is electrically connected to a signal line, a gate terminal thereof to a scanning line, and a drain terminal thereof to a pixel electrode, respectively. The pixel electrode forms a liquid crystal capacitance between itself and a common electrode that is commonly provided in all pixels. When a signal voltage (driving image signal) in accordance with image data is written into the liquid crystal capacitance from the signal line via the TFT, liquid crystal molecules are oriented in a direction corresponding to the signal voltage, and the liquid crystal display device displays an image represented by the image data.

This liquid crystal capacitance is expressed by the following expression when a liquid crystal dielectric constant is ∈, an area of the facing surfaces of the pixel electrode and the common electrode is S and the common electrode is S and a distance between the pixel electrode and the common electrode is d.

$$Clc=\in\times S/d$$

This liquid crystal dielectric constant ∈and the liquid crystal capacitance Clc have anisotropy, and values thereof vary depending on the orientation direction of the liquid crystal molecules. Since the orientation direction of the liquid crystal molecules cannot sufficiently change as following the applied voltage within a writing period, it changes even after the end of the writing period. As thus described, the liquid crystal applied voltage changes in association with the change in liquid crystal capacitance after the end of the writing period, and hence a desired liquid crystal transmittance is not reached by one refresh.

FIG. 17 is one example of a timing chart showing normal drive in a conventional liquid crystal display device. As shown in FIG. 17, a positive polarity voltage and a negative polarity voltage for performing white display are alternately applied to the liquid crystal capacitance in every scanning period. In a first scanning period, when the positive polarity voltage is applied to the liquid crystal capacitance, the liquid crystal molecules are orientated so as to come close to a direction corresponding to the applied voltage. However, since the liquid crystal capacitance does not reach a capacitance (dashed line in the drawing) required for the white display, the applied voltage does not reach a voltage Va required for the white display. Also in the case of applying the negative polarity voltage to the liquid crystal capacitance in a second scanning period, the liquid crystal molecules are orientated so as to come close to a direction corresponding to the applied voltage. However, the liquid crystal capacitance does not reach the capacitance required for the white display, and the applied voltage also does not reach a voltage Va. When the positive polarity voltage is applied to the liquid crystal capacitance in a third scanning period, the liquid crystal capacitance reaches the capacitance (dashed line in the drawing) required for the white display, and the applied voltage also reaches the voltage Va required for the white display. Therefore, a voltage difference as shown in FIG. 18, which will be described later, is not generated and an afterimage is not visually recognized.

Next, conventional pause drive will be described. FIG. 18 is one example of a timing chart showing first pause drive in the conventional liquid crystal display device. As shown in FIG. 18, just one frame period is provided as the scanning period. In this scanning period, a negative polarity voltage is applied to the liquid crystal capacitance for performing the white display, and periods thereafter are pause periods. The liquid crystal molecules are orientated so as to come close to a direction corresponding to the voltage applied in the scanning period. However, since the orientation direction of the liquid crystal molecules cannot sufficiently change as following the applied voltage within a writing period, a change in liquid crystal capacitance is delayed as compared to a change in applied voltage. For this reason, the liquid crystal capacitance at the end of the writing period cannot reach the capacitance (dashed line in the drawing) required for the white display. As a result, the applied voltage of the liquid crystal capacitance does not reach the voltage Va required for the white display, but only reaches a voltage Vb lower than that. Hence there is generated a difference between the voltages Va and Vb. This difference between the voltages causes an afterimage to be visually recognized on the screen.

Accordingly, an object of the present invention is to provide a liquid crystal display device and a drive method thereof, capable of promptly making an afterimage, which is visually recognized during pause drive, visually unrecognizable while suppressing power consumption.

Means for Solving the Problems

According to a first aspect of the present invention, there is provided a liquid crystal display device which performs pause drive at a predetermined refresh rate target refresh rate, the device including:

a display portion including a plurality of pixel formation portions;

a drive portion for driving the display portion; and a display control portion for controlling the drive portion based on data received from the outside, wherein, when image data included in the data is updated, the display control portion performs a refresh once by use of the updated image data, and then makes a refresh pause just in a pause period that is decided in accordance with a refresh rate of the image data, and after the end of the pause period, the display control portion performs a refresh at least once or more by use of the same image data as the updated image data.

According to a second aspect of the present invention, in the first aspect of the present invention, wherein the number of times of refreshes performed after the end of the pause period is two.

According to a third aspect of the present invention, in the second aspect of the present invention, wherein twice of refreshes, which are performed after the end of the pause period, are consecutively performed.

According to a fourth aspect of the present invention, in the second aspect of the present invention, wherein twice of refreshes, which are performed after a lapse of the pause period, are performed with a period for making a refresh pause therebetween.

According to a fifth aspect of the present invention, in the first aspect of the present invention, wherein the predetermined refresh rate is irregularly switched, and when the refresh rate is changed, a length of the pause period is also changed accordingly.

According to a sixth aspect of the present invention, in the first aspect of the present invention, wherein the predetermined refresh rate is irregularly switched, and even when the refresh rate is changed, a length of the pause period is constant.

According to a seventh aspect of the present invention, in the first aspect of the present invention, wherein, the display control portion performs control for Alternating Current (AC) drive, and a plurality of positive polarity frames made up of a refresh frame for performing a refresh with positive polarity and a non-refresh frame for holding the positive polarity and a plurality of negative polarity frames made up of a refresh frame for performing a refresh with negative polarity and a non-refresh frame for holding the negative polarity are alternately provided in approximately the same proportion.

According to an eighth aspect of the present invention, in the first aspect of the present invention, wherein when the display control portion receives new data from the outside, the data including image data for updating a screen of the display portion at the time of performing a refresh or making a refresh pause, the display control portion stops the refresh or the refresh pause, performs a refresh once by use of the image data included in the new data, then makes a refresh pause just in the pause period that is decided in accordance with a refresh rate of the image data, and performs a refresh at least once or more by use of the same image data as the updated image data after the end of the pause period.

According to a ninth aspect of the present invention, in the eighth aspect of the present invention, wherein when the image data included in the data received from the outside has not been updated, the display control portion makes a refresh pause that is performed after the end of the pause period.

According to a tenth aspect of the present invention, in the eighth aspect of the present invention, wherein, the display control portion includes a frame memory that stores the image data included in the data just for one frame, and when not receiving the updated image data from the outside, the display control portion performs a refresh once by use of the image data read from the frame memory, and makes a refresh pause after the end of the pause period.

According to an eleventh aspect of the present invention, in the first aspect of the present invention, wherein the pixel formation portion includes a thin-film transistor having a control terminal connected to a scanning line in the display portion, a first conduction terminal connected to a signal line in the display portion, a second conduction terminal connected to a pixel electrode in the display portion, which is to be applied with a voltage in accordance with an image to be displayed, and a channel layer formed of an oxide semiconductor.

According to a twelfth aspect of the present invention, in the eleventh aspect of the present invention, wherein the oxide semiconductor is InGaZnOx mainly composed of indium (In), gallium (Ga), zinc (Zn) and oxygen (O).

According to a thirteenth aspect of the present invention, there is provided a method for driving a liquid crystal display device which includes a display portion including a plurality of pixel formation portions, a drive portion for driving the display portion, and a display control portion for controlling the drive portion based on data received from the outside, the device performing pause drive at a predetermined refresh rate, the method including the steps of:

performing a refresh once by use of updated image data when image data included in the data is updated;

making a refresh pause just in a pause period that is decided in accordance with a refresh rate of the image data; and performing a refresh at least once or more by use of the same image data as the updated image data after the end of the pause period.

Effects of the Invention

According to the first aspect of the present invention, when image data received from the outside is updated, a refresh is performed once by use of the updated image data, and next, a refresh pauses just in a pause period that is decided in accordance with a refresh rate of the image data. Then, after the end of the pause period, a refresh is performed at least once or more by use of the same image data as the updated image data. Hence it is possible to perform a plurality of refreshes in a short period after receiving the updated image data, so as to make the liquid crystal molecules oriented in the direction corresponding to the applied voltage in a short time. Hence it is possible to make an afterimage during the pause drive, which is caused by anisotropy of a liquid crystal dielectric constant, visually unrecognizable while suppressing the power consumption of the liquid crystal display device.

According to the second aspect of the present invention, since a refresh can be performed by use of the updated image data three times in total, it is possible to make the liquid crystal molecules oriented in the direction corresponding to the applied voltage. Hence it is possible to make an afterimage, which is caused by anisotropy of a liquid crystal dielectric constant, visually unrecognizable.

According to the third aspect of the present invention, since twice of refreshes, which are performed after the end of the pause period, are consecutively performed, it is possible to finish in a short time a total of three times of refreshes that are performed by use of the updated image data. Hence it is possible to make an afterimage during the pause drive, which is caused by anisotropy of a liquid crystal dielectric constant, visually unrecognizable.

According to the fourth aspect of the present invention, twice of refreshes that are performed after a lapse of the pause period are performed with a period for making a refresh pause therebetween. Thereby, when the refresh rate of the image data is 10 Hz, a refresh is performed once after the lapse of the pause period, and hence it is possible to reduce the power consumption of the liquid crystal display device.

According to the fifth aspect of the present invention, the refresh rate during the pause drive is irregularly switched, and a length of the pause period is changed accordingly. As thus described, by resetting the length of the pause period, it is possible to reliably make an afterimage during the pause drive visually unrecognizable regardless of the refresh rate.

According to the sixth aspect of the present invention, even when the refresh rate during the pause drive is irregularly switched, the length of the pause period is constant. In this case, since only one register for storing the length of the pause period may be provided, it is possible to reduce manufacturing cost of the liquid crystal display device.

According to the seventh aspect of the present invention, the positive polarity frames and the negative polarity frames are alternately provided in approximately the same proportion, and hence Alternating Current (AC) drive is performed on the liquid crystal layer of the pixel formation portion. Hence it is possible to suppress deterioration in liquid crystal layer.

According to the eighth aspect of the present invention, when new image data is received from the outside at the time of a refresh being performed or a refresh pausing, the refresh or the refresh pause having been performed up to then is stopped, and the first refresh is performed by use of the new image data. Thereby, when the image data is updated, the screen on the display portion is also immediately refreshed, and the updated image can be displayed.

According to the ninth aspect of the present invention, when the same image data as the image data transmitted immediately before is transmitted from the host, even when the number of times of refreshes is decreased, an afterimage is not visually recognized. Hence it is possible to reduce the power consumption of the liquid crystal display device.

According to the tenth aspect of the present invention, in the case of performing a refresh by use of image data read from the frame memory, even when the number of times of refreshes is decreased, an afterimage is not visually recognized. Hence it is possible to reduce the power consumption of the liquid crystal display device.

According to the eleventh aspect of the present invention, the thin-film transistor in which the channel layer is formed of an oxide semiconductor is used as the thin-film transistor in the pixel formation portion. Thereby, a voltage written into the pixel formation portion is held over a long time, thereby allowing suppression of deterioration in display quality of the liquid crystal display device even in the case of the refresh rate being low.

According to the twelfth aspect of the present invention, by use of InGaZnOx as the oxide semiconductor that forms the channel layer, it is possible to reliably achieve the effect by the ninth aspect of the present invention.

According to the thirteenth aspect of the present invention, a similar effect to the effect by the first aspect of the present invention is achieved.

MODE FOR CARRYING OUT THE INVENTION

<1. Basic Consideration>

<1.1 First Basic Consideration>

Figure 1:
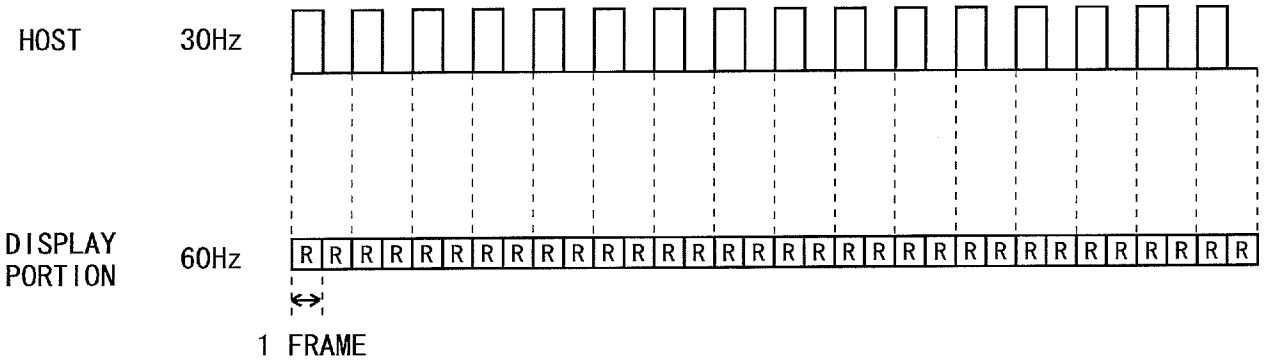
FIG. 1 is a diagram for explaining a refresh operation of a liquid crystal display device at the time of image data being updated at 30 Hz in a first basic consideration.
Figure 2:
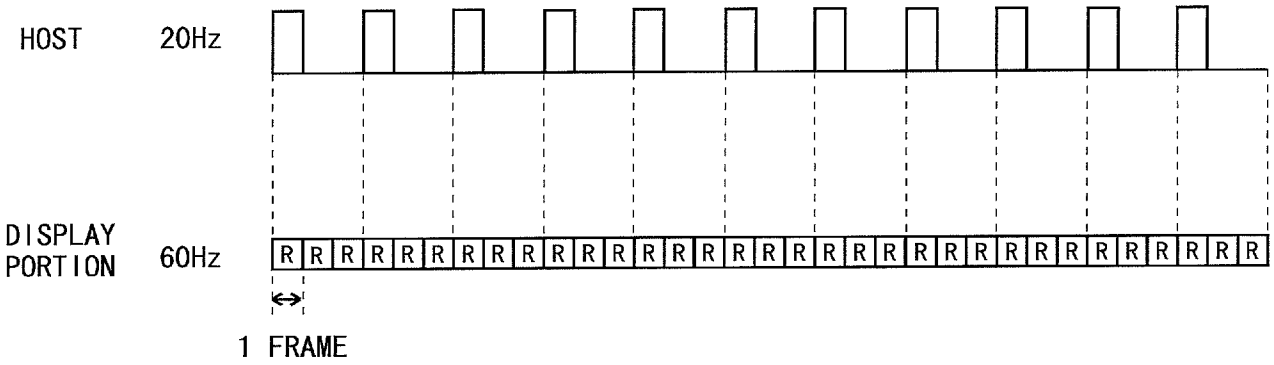
FIG. 2 is a diagram for explaining a refresh operation of the liquid crystal display device at the time of image data being updated at 20 Hz in the first basic consideration.

FIG. 1 is a diagram for explaining a refresh operation of a liquid crystal display device at the time of image data being updated at 30 Hz, and FIG. 2 is a diagram for explaining a refresh operation of the liquid crystal display device at the time of image data being updated at 20 Hz.

First, with reference to FIG. 1, a description will be given of a case where image data updated at 30 Hz is transmitted from a host. In this case, image data is updated once every two frames. In order to make an afterimage, which is caused by anisotropy of a liquid crystal dielectric constant, visually unrecognizable, it is preferable that upon the reception of such image data, a display control circuit perform the first refresh in the first frame by use of the updated image data and thereafter perform a refresh in the second and third frames by use of the same image data, thereby performing a refresh three times in total. Then, the second refresh is performed in the second frame where a refresh has been scheduled to pause. However, when the third refresh is about to be performed in the third frame, the next updated image data is transmitted from the host.

Then, without performing the third refresh in the third frame, the display control circuit performs the first refresh by use of the updated image data, and further performs the second refresh in the fourth frame by use of the same image data. However, when a third refresh is about to be performed in the fifth frame, further updated image data is transmitted from the host. Then, without performing the third refresh in the fifth frame, the display control circuit performs the first refresh by use of the updated image data, and further performs the second refresh in the sixth frame by use of the same image data.

Hereinafter, in a similar manner, a refresh is performed in an odd-numbered frame by use of image data transmitted from the host, and a refresh is performed in an even-numbered frame by use of the same image data as in the odd-numbered frame immediately therebefore. As a result, an image refreshed in all the frames is displayed on a display portion of the liquid crystal display device even though the image data is being updated once every two frames. That is, it follows that the liquid crystal display device is being operated at 60 Hz even though the host is being operated at 30 Hz, and hence the power consumption of the liquid crystal display device cannot be reduced by this drive method. In this case, a refresh is performed only twice every time the image data is updated, and hence an afterimage is slightly left. However, that afterimage will not be a concern since the image data is updated at the refresh rate as high as 30 Hz.

Next, with reference to FIG. 2, a description will be given of a case where image data updated at 20 Hz is transmitted from the host. In this case, image data is updated once every three frames. In order to make an afterimage, which is caused by anisotropy of a liquid crystal dielectric constant, visually unrecognizable, upon the reception of such image data, the display control circuit performs the first refresh in the first frame by use of the updated image data, and thereafter performs a refresh in the second and third frames by use of the same image data. The second and third refreshes are performed in the second and third frames where a refresh has been scheduled to pause.

When the third refresh is finished, the next updated image data is transmitted from the host. Then, the display control circuit performs the first refresh in the fourth frame by use of the updated image data, and thereafter, it further performs the second and third refreshes by use of the same image data. The second and third refreshes are performed in the fifth and sixth frames where a refresh has been scheduled to pause.

Hereinafter, in a similar manner, there is made a repetition of performing the first refresh upon the transmission of image data and consecutively performing the second and third refreshes. As a result, an image refreshed in all the frames is displayed on the display portion of the liquid crystal display device even though the image data is being updated once every three frames. That is, it follows that the liquid crystal display device is being operated at 60 Hz even though the host is being operated at 20 Hz, and hence the power consumption of the liquid crystal display device cannot be reduced by this drive method. In this case, every time the image data is updated, a refresh is performed three time, and hence an afterimage is not visually recognized.

In such a manner, by performing a refresh twice or three times by use of image data updated at 30 Hz or 20 Hz, an afterimage caused by anisotropy of a liquid crystal dielectric constant can be reduced or made visually unrecognizable, but in either case, the power consumption of the liquid crystal display device cannot be reduced.

<1.2 Second Basic Consideration>

Figure 3:
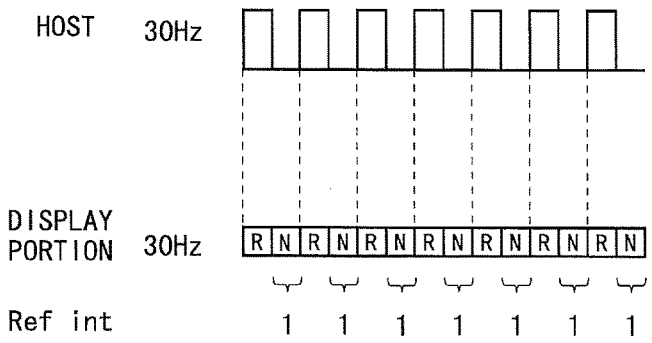
FIG. 3 is a diagram showing the relationship between a refresh rate of image data and the number of non-refresh frames in a second basic consideration, and more specifically, (a) is a diagram showing the relationship between a refresh rate of the image data and the number of non-refresh frames in the case of the refresh rate being 30 Hz, (b) is a diagram showing the relationship between a refresh rate of the image data and the number of non-refresh frames in the case of the refresh rate being 20 Hz, and (c) is a diagram showing the relationship between a refresh rate of the image data and the number of non-refresh frames in the case of the refresh rate being 15 Hz.
Figure 3:
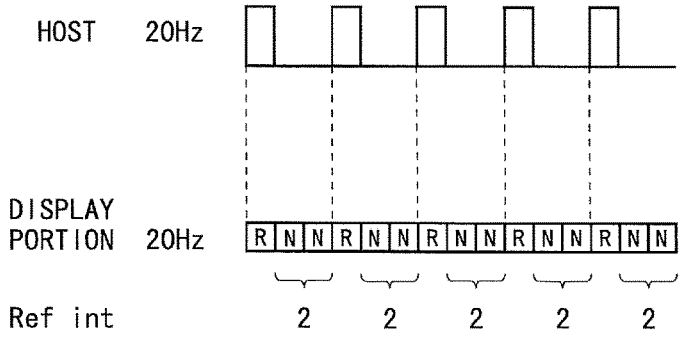
Figure 3:
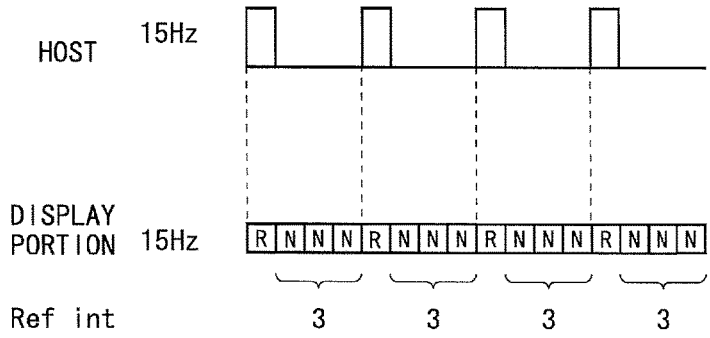

FIG. 3(*a*) to FIG. 3(*c*) are diagrams each showing the relationship between a refresh rate of image data and the number of non-refresh frames, and more specifically, FIG. 3(*a*) is a diagram showing the relationship between a refresh rate of the image data and the number of non-refresh frames in the case of the refresh rate being 30 Hz, FIG. 3(*b*) is a diagram showing the relationship between a refresh rate of the image data and the number of non-refresh frames in the case of the refresh rate being 20 Hz, and FIG. 3(*c*) is a diagram showing the relationship between a refresh rate of the image data and the number of non-refresh frames in the case of the refresh rate being 15 Hz. It is to be noted that in the following description, when just k non-refresh frames for making a refresh pause are to be provided between two refresh frames, it is referred to as setting Ref_int to k (k is an integer not smaller than 1). Further, a period for making a refresh pause, which is decided by Ref_int, is also referred to as a pause period.

As shown in FIG. 3(*a*), in the case of performing a refresh for displaying an image in accordance with the image data at a refresh rate of 30 Hz, when Ref_int is set to 2, the first refresh is performed in the first frame and a refresh pauses in the second frame. Further, when a refresh is about to pause also in the third frame, the next updated image data is transmitted. Then, a refresh is performed by an auto-refresh function. A refresh pauses in the fourth frame, but in the fifth frame, updated image data is transmitted and hence a refresh is performed, as in the case of the third frame. Hereinafter, in a similar manner, a refresh is performed in an odd-numbered frame and a refresh pauses in an even-numbered frame. As thus described, even though Ref_int has been set to 2, the same result as in the case of setting Ref_int to 1 is obtained. Also in the case of setting Ref_int to not smaller than 3, the same result as in the above case is obtained.

It should be noted that the auto-refresh function means a function in which, even if it is scheduled to perform a refresh by use of the same image data as that in the refresh immediately before or to perform a non-refresh, when updated image data is transmitted from the host, those operations are stopped and the first refresh is restarted by use of the updated image data. By performing an auto-refresh, when the image data is updated, the screen on the display portion is also immediately refreshed, and the updated image can be displayed.

As shown in FIG. 3(*b*), in the case of performing a refresh for displaying an image in accordance with image data at a refresh rate of 20 Hz, when Ref_int is set to 3, the first refresh is performed in the first frame and a refresh pauses in the second and third frames. Further, when a refresh is about to pause also in the fourth frame, the next updated image data is transmitted, and hence a refresh is performed by the auto-refresh function. A refresh pauses in the fifth and sixth frames, but in the seventh frame, updated image data is transmitted and hence a refresh is performed as in the case of the fourth frame. Hereinafter, in a similar manner, a refresh is performed once every three frames, and a refresh pauses in two frames immediately thereafter. As thus described, even though Ref_int has been set to 3, the same result as in the case of setting Ref_int to 2 is obtained. Also in the case of setting Ref_int to not smaller than 4, the same result as in the above case is obtained.

As shown in FIG. 3(*c*), in the case of performing a refresh for displaying an image in accordance with image data updated at 15 Hz, when Ref_int is set to 4, the first refresh is performed in the first frame and a refresh pauses in the second to fourth frames. Further, when a refresh is about to pause also in the fifth frame, the next updated image data is transmitted, and hence a refresh is performed by the auto-refresh function. A refresh pauses in the sixth to eighth frames, but in the ninth frame, updated image data is transmitted and hence a refresh is performed as in the case of the fifth frame. Hereinafter, in a similar manner, a refresh is performed once every four frames, and a refresh pauses in three frames immediately thereafter. As thus described, even though Ref_int has been set to 4, the same result as in the case of setting Ref_int to 3 is obtained. Also in the case of setting Ref_int to not smaller than 5, the same result as in the above case is obtained.

As thus described, it is found that in the case of providing a non-refresh frame in order to perform the pause drive by use of image data updated in a predetermined cycle, the number of non-refresh frames is decided in accordance with a refresh rate of the image data. In particular, since it is necessary to make a refresh for making an afterimage, which is caused by anisotropy of a liquid crystal dielectric constant, visually unrecognizable in a short period, Ref_int is preferably small. Then, in each embodiment described below, a description will be given assuming that Ref_int is 2 unless otherwise described.

<2. First Embodiment>

<2.1 Configuration and Operation Summary of Liquid Crystal Display Device>

Figure 4:
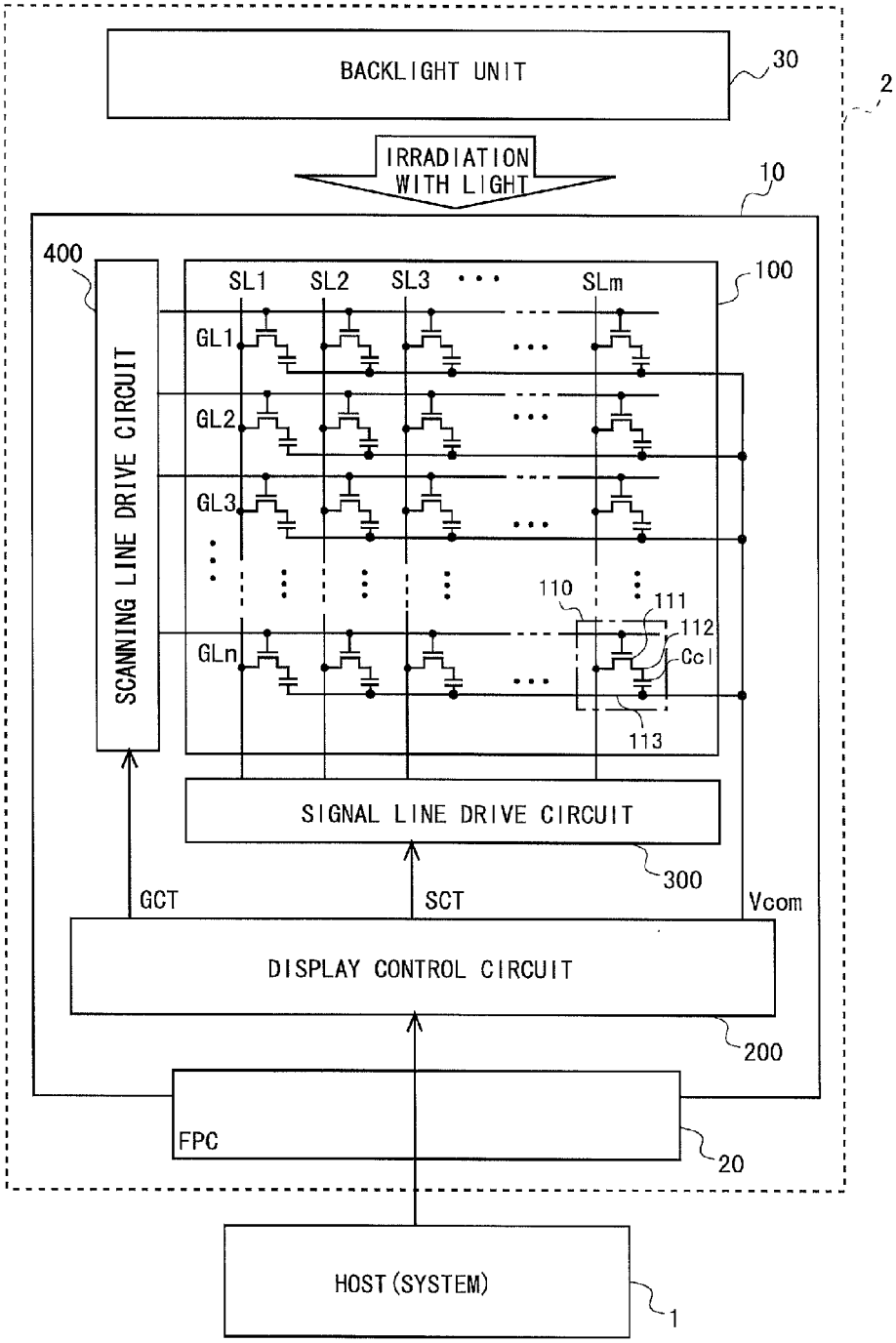
FIG. 4 is a block diagram showing a configuration of a liquid crystal display device according to a first embodiment of the present invention.

FIG. 4 is a block diagram showing a configuration of a liquid crystal display device 2 according to a first embodiment of the present invention. As shown in FIG. 4, the liquid crystal display device 2 is provided with a liquid crystal display panel 10 and a backlight unit 30. The liquid crystal display panel 10 is provided with an FPC (Flexible Printed Circuit) 20 for connection with the outside. Further, a display portion 100, a display control circuit 200, a signal line drive circuit 300 and a scanning line drive circuit 400 are provided on the liquid crystal display panel 10. It is to be noted that both or either one of the signal line drive circuit 300 and the scanning line drive circuit 400 may be provided in the display control circuit 200. Further, both or either one of the signal line drive circuit 300 and the scanning line drive circuit 400 may be formed integrally with the display portion 100. A host 1 (system) configured mainly of a CPU is provided outside the liquid crystal display device 2.

The display portion 100 is formed with a plurality of (m) signal lines SL1 to SLm, a plurality of (n) scanning lines GL1 to GLn, and a plurality of (m×n) pixel formation portions 110 which are provided corresponding to respective intersections of these m signal lines SL1 to SLm and n scanning lines GL1 to GLn. Here, both m and n are integers not smaller than 1. Hereinafter, when the m signal lines SL1 to SLm are not distinguished, these are simply referred to as a "signal line SL", and when the n scanning lines GL1 to GLn are not distinguished, these are simply referred to as a "scanning line GL". The m×n pixel formation portions 110 are formed in a matrix shape. Each pixel formation portion 110 is configured of: a TFT 111 whose gate terminal as a control terminal is connected to the scanning line GL passing through the corresponding intersection and whose source terminal as a first conduction terminal is connected to the signal line SL passing through the intersection; a pixel electrode 112 connected to a drain terminal of the TFT 111 as a second conduction terminal; a common electrode 113 commonly provided in the m×n pixel formation portions 110; and a liquid crystal layer sandwiched between the pixel electrode 112 and the common electrode 113, and commonly provided in the plurality of pixel formation portions 110. A liquid crystal capacitance Ccl formed by the pixel electrode 112 and the common electrode 113 constitutes a pixel capacitance. It is to be noted that typically, an auxiliary capacitance is provided in parallel with the liquid crystal capacitance Ccl so as to reliably hold a voltage in the pixel capacitance. For this reason, the pixel capacitance is made up of the liquid crystal capacitance Ccl and the auxiliary capacitance. However, in the present specification, the pixel capacitance will be described as being configured only of the liquid crystal capacitance Ccl.

As the TFT 111, for example, a TFT using an oxide semiconductor for a channel layer (hereinafter referred to as "oxide TFT") is used. More specifically, the channel layer of the TFT 111 is formed of InGaZnOx mainly composed of indium (In), gallium (Ga), zinc (Zn) and oxygen (O). Hereinafter, a TFT using InGaZnOx for the channel layer will be referred to as an "IGZO-TFT". The IGZO-TFT has a very small off-leak current as compared to a TFT using polycrystalline silicon, amorphous silicon, or the like for the channel layer, and hence a signal voltage written into the liquid crystal capacitance Ccl is held for a long period. Thereby, even when the refresh rate is low, it is possible to suppress the deterioration in display quality.

It should be noted that a similar effect is obtained also in the case of using for the channel layer an oxide semiconductor containing at least one of indium, gallium, zinc, copper (Cu), silicon (Si), tin (Sn), aluminum (Al), calcium (Ca), germanium (Ge), and lead (Pb), for example, as an oxide semiconductor other than InGaZnOx. Further, using the oxide TFT as the TFT 111 is one example, and in place of this, the TFT using polycrystalline silicon, amorphous silicon, or the like may be used.

The display control circuit 200 is typically realized by LSI (Large Scale Integration). The display control circuit 200 receives data DAT including image data from the host 1 via the FPC 20, and in accordance with this, the display control circuit 200 generates and outputs a signal line control signal SCT, a scanning line control signal GCT and a common potential Vcom. The signal line control signal SCT is given to the signal line drive circuit 300. The scanning line control signal GCT is given to the scanning line drive circuit 400. The common potential Vcom is given to the common electrode 113. In the present embodiment, transmission/reception of the data DAT between the host 1 and the display control circuit 200 is performed via an interface conforming to the DSI (Display Serial Interface) standard proposed by the MIPI (Mobile Industry Processor Interface) Alliance. This interface conforming to the DSI standard enables data transmission at high speed. In the present embodiment, a video mode or a command mode of the interface conforming to the DSI standard is used.

The signal line drive circuit 300 generates and outputs a driving image signal to be given to the signal line SL in accordance with the signal line control signal SCT. The signal line control signal SCT, for example, includes a digital image signal corresponding to RGB data RGBD, a source start pulse signal, a source clock signal, a latch strobe signal, and the like. The signal line drive circuit 300 gets a shift register, a sampling latch circuit, and the like, which are located inside and not shown, to operate in accordance with the source start pulse signal, the source clock signal and the latch strobe signal, and converts a digital signal obtained based on the digital image signal to an analog signal in a DA conversion circuit, not shown, thereby generating the driving image signal.

The scanning line drive circuit 400 repeats application of an active scanning signal to the scanning line GL in a predetermined cycle in accordance with the scanning line control signal GCT. The scanning line control signal GCT includes a gate clock signal and a gate start pulse signal, for example. The scanning line drive circuit 400 gets a shift register and the like, located inside and not shown, to operate in accordance with the gate clock signal and the gate start pulse signal, thereby generating a scanning signal.

The backlight unit 30 is provided on the rear surface side of the liquid crystal display panel 10, and irradiates the rear surface of the liquid crystal display panel 10 with backlight. The backlight unit 30 typically includes a plurality of LEDs (Light Emitting Diodes). The backlight unit 30 may be one controlled by the display control circuit 200 or may be one controlled by another method. It is to be noted that, when the liquid crystal display panel 10 is a reflection type, the backlight unit 30 is not required to be provided.

In such a manner as above, the driving image signal is applied to the signal line SL, the scanning signal is applied to the scanning line GL, and the backlight unit 30 is driven, whereby a screen in accordance with the image data transmitted from the host 1 is displayed on the display portion 100 of the liquid crystal display panel 10.

<2.2 Configuration of Display Control Circuit>

Next, a configuration of the display control circuit 200 will be described in three separate forms. A first form is a form in which the video mode is used and a RAM (Random Access Memory) is not provided. Hereinafter, such a first form will be referred to as "video mode RAM through". The second form is a form in which the video mode is used and the RAM is provided. Hereinafter, such a second form will be referred to as "video mode RAM capture". The third form is a form in which the command mode is used and the RAM is provided. Hereinafter, such a third form will be referred to as "command mode RAM write". It should be noted that, since the present invention is not restricted to the interface conforming to the DSI standard, the configuration of the display control circuit 200 is not restricted to these three kinds of forms.

<2.2.1 Video Mode RAM Through>

Figure 5:
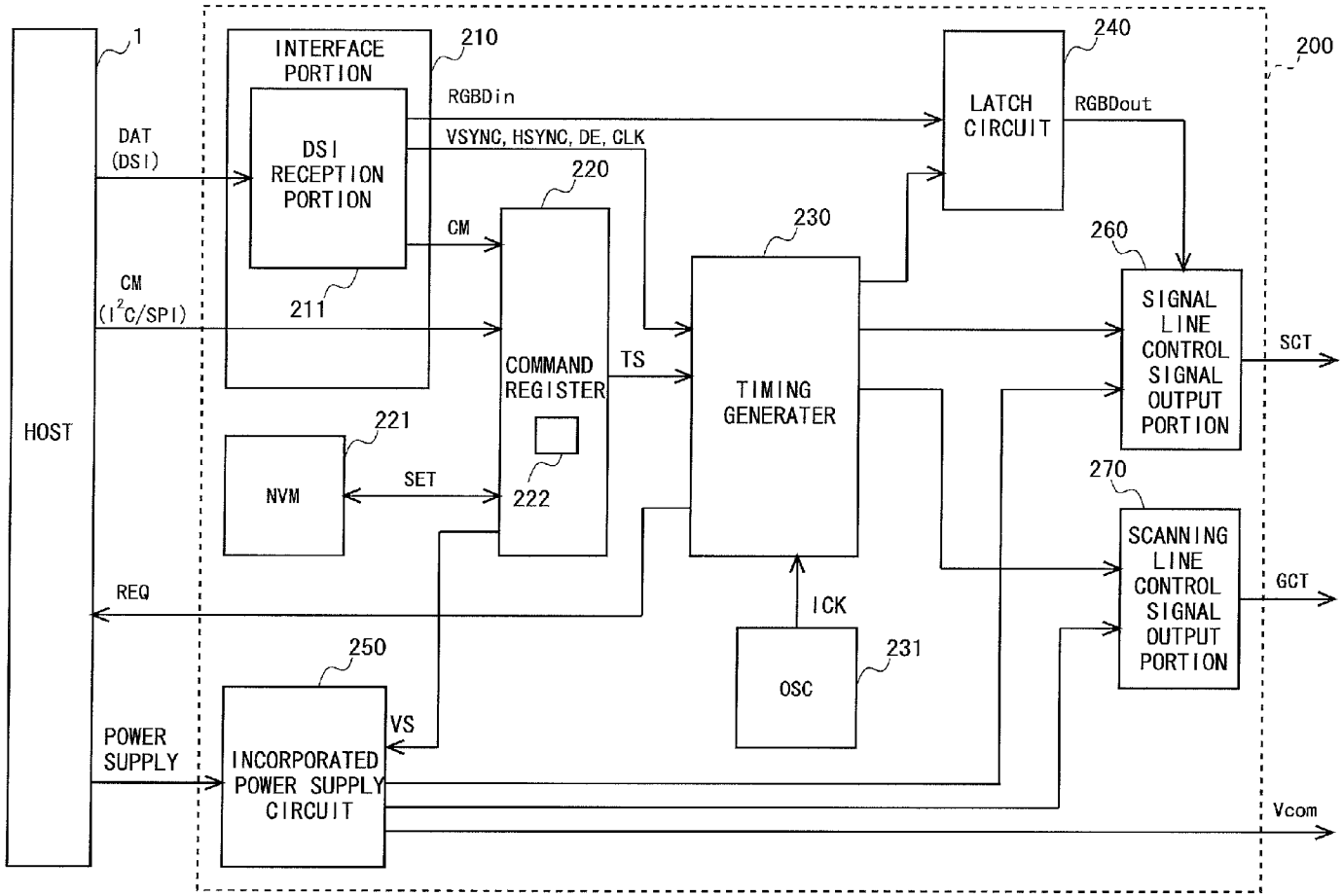
FIG. 5 is a block diagram showing a configuration of a display control circuit corresponding to video mode RAM through which is included in the liquid crystal display device shown in FIG. 4.

FIG. 5 is a block diagram showing the configuration of the display control circuit 200 corresponding to the video mode RAM through (hereinafter referred to as "display control circuit 200 of the video mode RAM through") included in the liquid crystal display device 2 shown in FIG. 4. As shown in FIG. 5, the display control circuit 200 is provided with an interface portion 210, a command register 220, an NVM (Non-volatile memory) 221, a timing generator 230, an OSC (Oscillator) 231, a latch circuit 240, an incorporated power supply circuit 250, a signal line control signal output portion 260, and a scanning line control signal output portion 270. A DSI reception portion 211 is included in the interface portion 210. In addition, as described above, both or either one of the signal line drive circuit 300 and the scanning line drive circuit 400 may be provided in the display control circuit 200.

The DSI reception portion 211 in the interface portion 210 conforms to the DSI standard. The data DAT in the video mode includes RGB data RGBD as image data; synchronization signals, i.e., a vertical synchronization signal VSYNC, a horizontal synchronization signal HSYNC, a data enable signal DE, a clock signal CLK; and command data CM. The command data CM includes data concerning a variety of control. When receiving the data DAT from the host 1, the DSI reception portion 211 transmits RGB data RGBDin included in the data DAT to the latch circuit 240, transmits the vertical synchronization signal VSYNC, the horizontal synchronization signal HSYNC, the data enable signal DE, and the clock signal CLK to the timing generator 230, and transmits the command data CM to the command register 220. It should be noted that the command data CM may be transmitted to the command register 220 from the host 1 via an interface conforming to the I2C (Inter Integrated Circuit) standard or the SPI (Serial Peripheral Interface) standard. In this case, the interface portion 210 includes a reception portion conforming to the I2C standard or the SPI standard.

The command register 220 holds the command data CM. Setting data SET for a variety of control are held in the NVM 221. The command register 220 reads the setting data SET held in the NVM 221. Further, the setting data SET can be updated in accordance with the command data CM transmitted from the host 1. Ref_int that is set in accordance with a refresh rate of image data is included in the setting data SET, and stored in a register 222 provided in the command register 220. The command register 220 generates a timing control signal TS for refreshing the screen of the display portion 100 based on the data that includes Ref_int stored in the register 222, and transmits this to the timing generator 230. Further, it transmits a voltage setting signal VS to the incorporated power supply circuit 250. It is to be noted that in FIG. 5, only one register 222 is described. However, with Ref_int being stored in the register 222, when the number of Ref_int to be set increases, the number of registers 222 is required to be increased accordingly.

The timing generator 230 transmits a control signal for controlling the latch circuit 240, the signal line control signal output portion 260, and the scanning line control signal output portion 270 based on the vertical synchronization signal VSYNC, the horizontal synchronization signal HSYNC, the data enable signal DE, the clock signal CLK, the timing control signal TS, and an incorporated clock signal ICK generated in the OSC 231.

Further, at the time of performing a refresh, in order to request the host 1 to transmit the data DAT, the timing generator 230 transmits to the host 1 a request signal REQ generated based on the vertical synchronization signal VSYNC, the horizontal synchronization signal HSYNC, the data enable signal DE, the clock signal CLK, the timing control signal TS, and the incorporated clock signal ICK generated in the OSC 231. It is to be noted that the OSC 231 is not essential in the display control circuit 200 of the video mode RAM through.

When receiving the request signal REQ, the host 1 transmits the data DAT to the display control circuit 200. As thus described, at the time of performing a refresh, the required data DAT is transmitted from the host 1 in each time in accordance with the request signal REQ, and the screen is refreshed based on the transmitted data DAT.

Based on control of the timing generator 230, the latch circuit 240 transmits the RGB data RGBDout included in the data DAT transmitted from the host 1 for each one line to the signal line control signal output portion 260. In such a manner, it is possible to perform a refresh of the screen just the required number of times.

Based on a power supply given from the host 1 and the voltage setting signal VS given from the command register 220, the incorporated power supply circuit 250 generates and outputs a power supply voltage and the common potential Vcom for use in the signal line control signal output portion 260 and the scanning line control signal output portion 270.

The signal line control signal output portion 260 generates the signal line control signal SCT based on the RGB data RGBDout from the latch circuit 240, the control signal from the timing generator 230, and the power supply voltage from the incorporated power supply circuit 250, and transmits this to the signal line drive circuit 300.

The scanning line control signal output portion 270 generates the scanning line control signal GCT based on the control signal from the timing generator 230 and the power supply voltage from the incorporated power supply circuit 250, and transmits this to the scanning line drive circuit 400.

<2.2.2 Video Mode RAM Capture>

Figure 6:
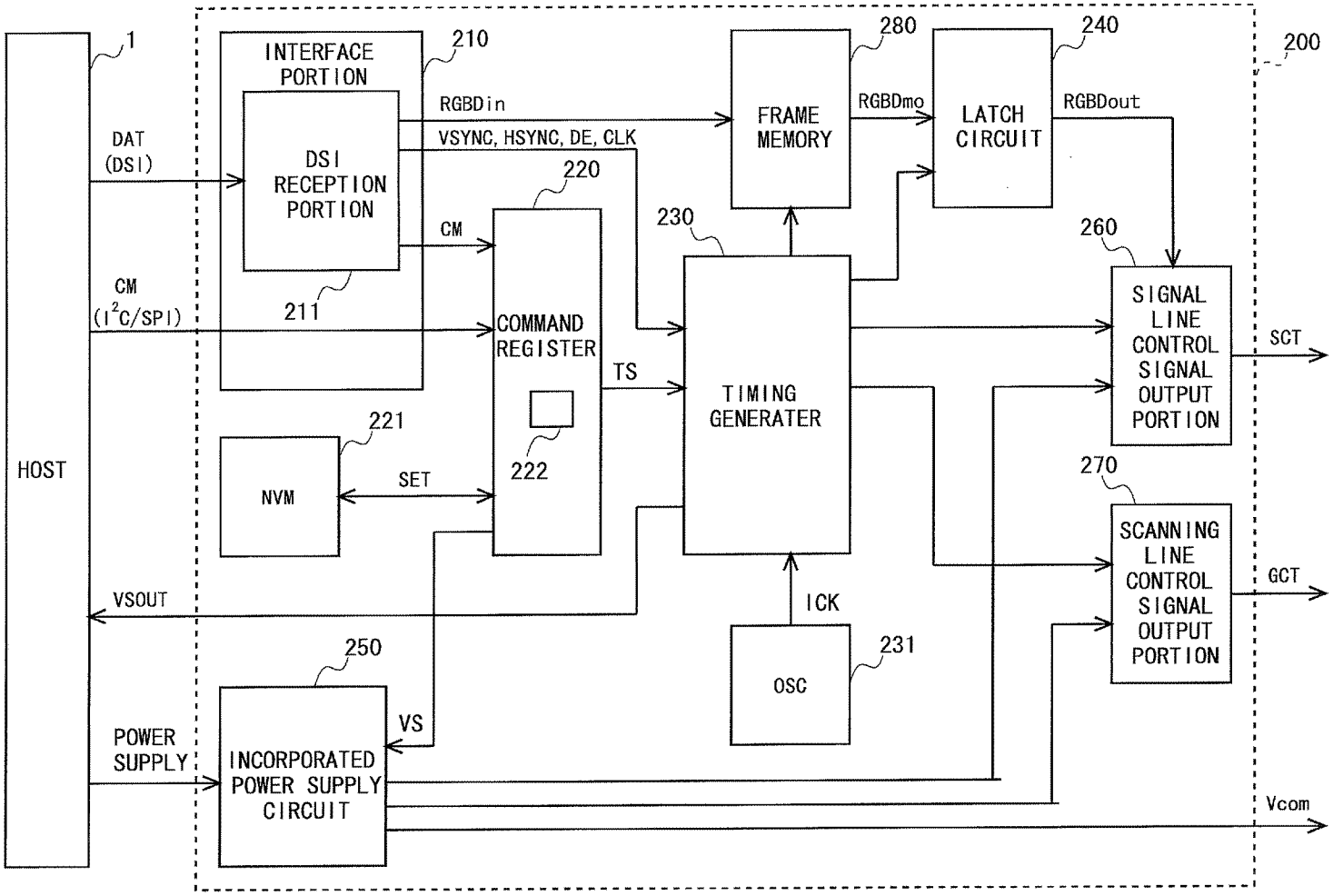
FIG. 6 is a block diagram showing a configuration of a display control circuit corresponding to video mode RAM capture which is included in the liquid crystal display device shown in FIG. 4.

FIG. 6 is a block diagram showing the configuration of the display control circuit 200 corresponding to the video mode RAM capture (hereinafter referred to as "display control circuit 200 of the video mode RAM capture") included in the liquid crystal display device 2 shown in FIG. 4. The display control circuit 200 of the video mode RAM capture is one obtained by adding a frame memory (RAM) 280 to the foregoing display control circuit 200 of the video mode RAM through, as shown in FIG. 6.

In the display control circuit 200 of the video mode RAM through, the RGB data RGBDin is directly transmitted from the DSI reception portion 211 to the latch circuit 240. However, in the display control circuit 200 of the video mode RAM capture, the RGB data RGBDin transmitted from the DSI reception portion 211 is held in the frame memory 280. Then, RGB data RGBDmo held in the frame memory 280 is read in the latch circuit 240 in accordance with the control signal generated in the timing generator 230. Further, the timing generator 230 transmits a vertical synchronization output signal VSOUT to the host 1 in place of the above request signal REQ. The vertical synchronization output signal VSOUT is a signal for controlling the timing for transmitting the data DAT from the host 1 such that the timing for writing the RGB data RGBDin into the frame memory 280 is not overlapped with the timing for reading the RGB data RGBDmo from the frame memory 280. The other configurations and operations of the display control circuit 200 of the video mode RAM capture are the same as those of the display control circuit 200 of the video mode RAM through, and hence descriptions thereof will be omitted. It is to be noted that the OSC 231 is not essential in the display control circuit 200 of the video mode RAM capture.

Further, when receiving the timing control signal TS for refreshing the screen of the display portion 100 from the command register 220, the timing generator 230 transmits the control signal to the frame memory 280. Thereby, RGB data RGBDmo held in the frame memory 280 is read in the latch circuit 240 in accordance with the control signal received from the timing generator 230.

In the display control circuit 200 of the video mode RAM capture, the RGB data RGBDmo can be held in the frame memory 280. For this reason, in the case of refreshing the screen, the data DAT is not required to be transmitted from the host 1 to the display control circuit 200, but in accordance with the number of times that a refresh is to be performed, the timing generator 230 transmits the control signal to the frame memory 280. In such a manner, by displaying the same image as the image currently displayed on the display portion 100, the image can be refreshed just the required number of times.

<2.2.3 Command Mode RAM Write>

Figure 7:
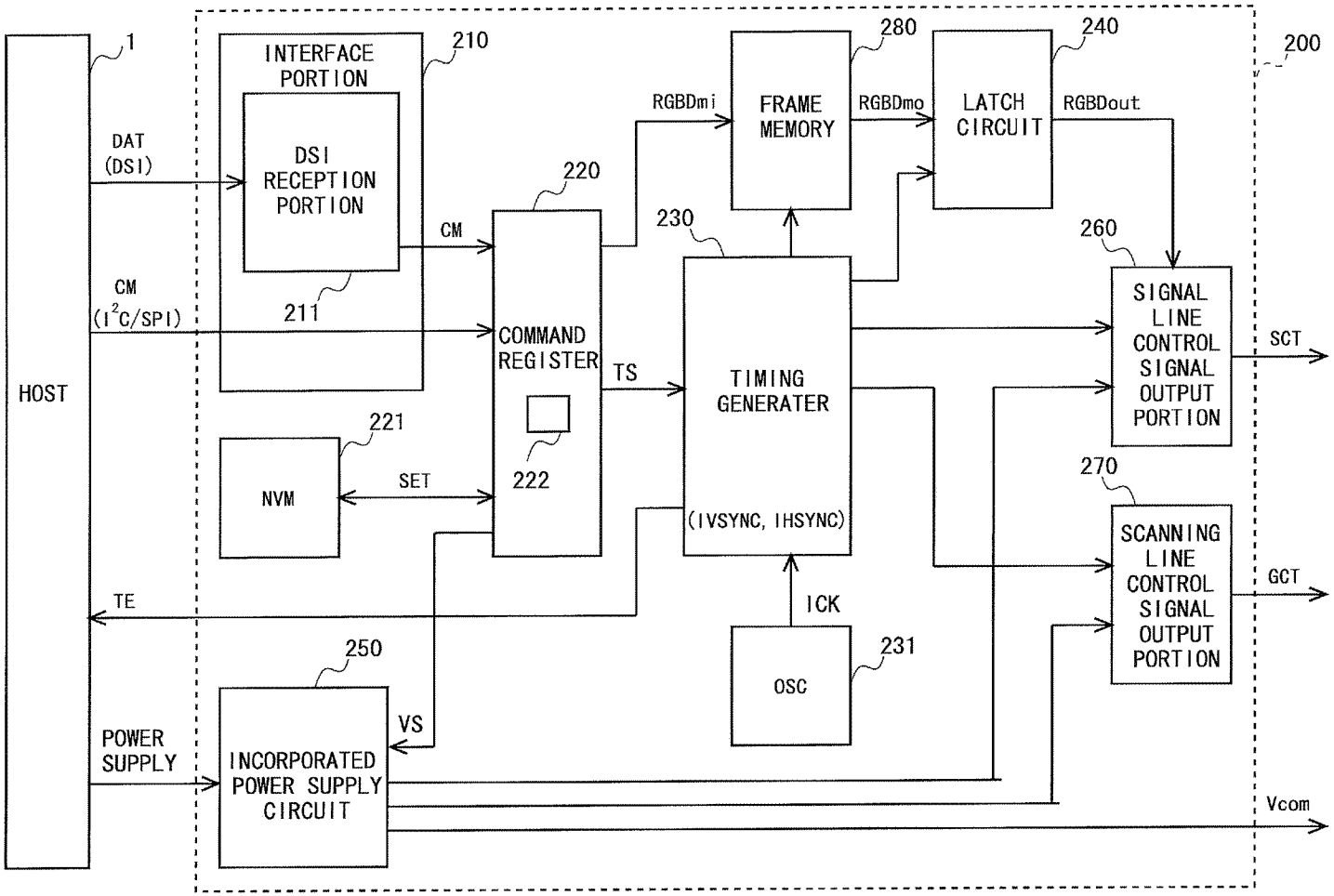
FIG. 7 is a block diagram showing a configuration of a display control circuit corresponding to a command mode RAM write which is included in the liquid crystal display device shown in FIG. 4.

FIG. 7 is a block diagram showing the configuration of the display control circuit 200 corresponding to the command mode RAM write (hereinafter referred to as "display control circuit 200 of the command mode RAM write") included in the liquid crystal display device 2 shown in FIG. 4. As shown in FIG. 7, the display control circuit 200 of the command mode RAM write has a similar configuration to that of the foregoing display control circuit 200 of the video mode RAM capture, but the kind of data included in the data DAT is different.

The data DAT in the command mode includes the command data CM, and does not include the RGB data RGBDin, the vertical synchronization signal VSYNC, the horizontal synchronization signal HSYNC, the data enable signal DE and the clock signal CLK. However, the command data CM in the command mode includes data concerning the image and data concerning a variety of timing. Out of the command data CM, the command register 220 transmits a RAM write signal RGBDmi that corresponds to the data concerning the image to the frame memory 280. This RAM write signal RAMW corresponds to the above RGB data RGBDin. Further, in the command mode, the timing generator 230 does not receive the vertical synchronization signal VSYNC and the horizontal synchronization signal HSYNC, and thus generates on its inside an internal vertical synchronization signal IVSYNC and an internal horizontal synchronization signal IHSYNC corresponding to the incorporated clock signal ICK and the timing control signal TS based on those signals. Based on these internal vertical synchronization signal IVSYNC and internal horizontal synchronization signal IHSYNC, the timing generator 230 controls the latch circuit 240, the signal line control signal output portion 260, and the scanning line control signal output portion 270. Further, the timing generator 230 transmits to the host 1 a transmission control signal TE corresponding to the above vertical synchronization output signal VSOUT.

In addition, the operations of the command register 220, the timing generator 230, and the frame memory 280 at the time of refreshing the screen are the same as the operations in the display control circuit 200 of the video mode RAM capture, and hence descriptions thereof will be omitted.

<2.3 Summary of Operation>

In the present specification, the pause drive means drive in which, when updated image data (RGB data RGBD) is given from the host 1, a frame for making a refresh of the screen pause (hereinafter referred to as "non-refresh frame") is provided after a frame for refreshing the screen (hereinafter referred to as "refresh frame"), and a predetermined number of each of these refresh frames and non-refresh frames are alternately repeated. For example, as in the foregoing cases shown in FIGS. 1 and 2, each rectangular box in each drawing described later shows one frame, a refresh frame is provided with "R", and a non-refresh frame is provided with "N".

In the refresh frame, the screen is refreshed as described above. More specifically, the driving image signal is supplied from the signal line drive circuit 300 to the signal lines SL1 to SLm in accordance with the signal line control signal SCT that includes the digital image signal corresponding to the RGB data RGBD, and the scanning lines GL1 to GLn are sequentially selected by the scanning line drive circuit 400 in accordance with the scanning line control signal GCT. The TFT 111 corresponding to the selected scanning line GL comes into an on-state, and a voltage of the driving image signal is written into the liquid crystal capacitance Ccl. In such a manner, the screen is refreshed. Subsequently, the TFT 111 comes into an off-state, and the voltage written into the liquid crystal capacitance Ccl is held until the screen is next refreshed.

In the non-refresh frame, the foregoing refresh of the screen pauses. More specifically, the supply of the scanning line control signal GCT to the scanning line drive circuit 400 is halted or the scanning line control signal GCT becomes a fixed potential, whereby the operation of the scanning line drive circuit 400 is halted, and hence scanning of the scanning lines GL1 to GLn is not performed. As a result, the driving image signal is not written into the liquid crystal capacitance Ccl in the non-refresh frame. However, since the driving image signal having been written immediately before is held in the liquid crystal capacitance Ccl, the screen refreshed in the refresh frame immediately before continues to be displayed. Further, in the non-refresh frame, the operation of the signal line drive circuit 300 is halted by halting the supply of the signal line control signal SCT to the signal line drive circuit 300, or the like. As thus described, in the non-refresh frame, the operations of the scanning line drive circuit 400 and the signal line drive circuit 300 are halted, thereby allowing reduction in power consumption. It is to be noted that the signal line drive circuit 300 may be operated.

In order to prevent an afterimage, which is caused by anisotropy of a liquid crystal dielectric constant, from being visually recognized during the pause drive, when the updated RGB data RGBD is transmitted from the host 1 to the liquid crystal display device 2, a refresh of writing the voltage of the driving image signal corresponding to the same RGB data RGBD into the liquid crystal capacitance Ccl is performed three times. By performing a refresh three times, it is possible to make the liquid crystal molecules oriented in the direction corresponding to the applied voltage. It is to be noted that in the present specification, a description will be given assuming that, when the updated RGB data RGBD is transmitted from the host 1, the liquid crystal display device 2 performs a refresh three times, but it may perform a refresh four times or more. By performing a refresh four times or more, it is possible to more reliably make the liquid crystal molecules oriented in the direction corresponding to the applied voltage, so as to more reliably make an afterimage visually unrecognizable.

Further, the number of non-refresh frames, provided between the first refresh that is performed at the time of the image data being updated and the second refresh that is performed thereafter, is decided by Ref_int, and Ref_int is stored in the register 222 provided in the command register 220. When generating the timing control signal TS for refreshing the screen of the display portion 100, the command register 220 transmits to the timing generator 230 the timing control signal TS having been generated by reading Ref_int from the register 222.

<2.4 Operation in Pause Drive>

Figure 8:
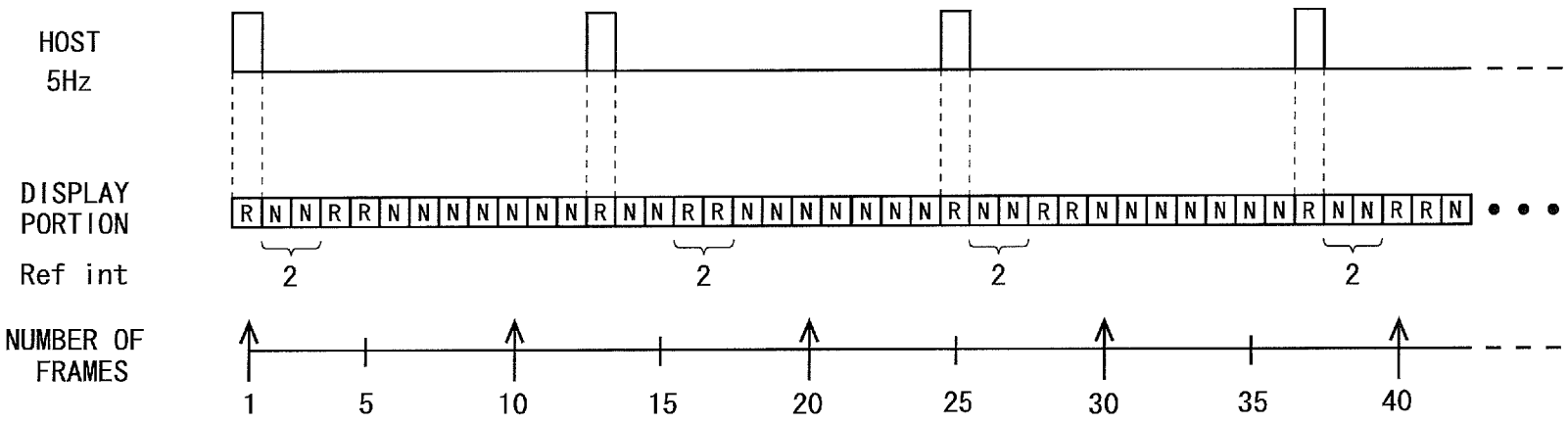
FIG. 8 is a diagram for explaining an operation, in pause drive, of a liquid crystal display device according to the first embodiment of the present invention.

FIG. 8 is a diagram for explaining an operation, in the pause drive, of the liquid crystal display device 2 according to the present embodiment. The liquid crystal display device 2 is a display device provided with an auto-refresh function. Further, in the present embodiment, Ref_int is set to 2.

First, in the first frame, since updated image data is transmitted, the first refresh is performed by use of this image data, and based on Ref_int, a refresh pauses in the second and third frames. Next, the second and third refreshes are consecutively performed in the fourth and fifth frames by use of the same image data as the image data used in the first refresh. Subsequently, a refresh pauses from the sixth frame to the twelfth frame.

In the thirteenth frame, since updated image data is transmitted, the first refresh is performed by use of this image data, and based on Ref_int, a refresh pauses in the fourteenth and fifteenth frames. Next, the second and third refreshes are consecutively performed in the sixteenth and seventeenth frames by use of the same image data as the image data used in the first refresh.

Subsequently, a refresh pauses from the eighteenth frame to the twenty-fourth frame.

Similarly, when updated image data is transmitted, the first refresh is performed by use of this image data, and based on Ref_int, a refresh pauses just for the next two frames. Then, the second and third refreshes are consecutively performed, and a refresh pause is repeated until the next updated image data is transmitted.

<2.5 Effect>

According to the present embodiment, since a refresh can be performed three times in a short period from the reception of updated image data, it is possible to make the liquid crystal molecules oriented in the direction corresponding to the applied voltage in a short time. Hence it is possible to make an afterimage, which is caused by anisotropy of a liquid crystal dielectric constant, visually unrecognizable while suppressing the power consumption of the liquid crystal display device 2.

<2.6 Modified Example>

<2.6.1 First Modified Example>

Figure 9:
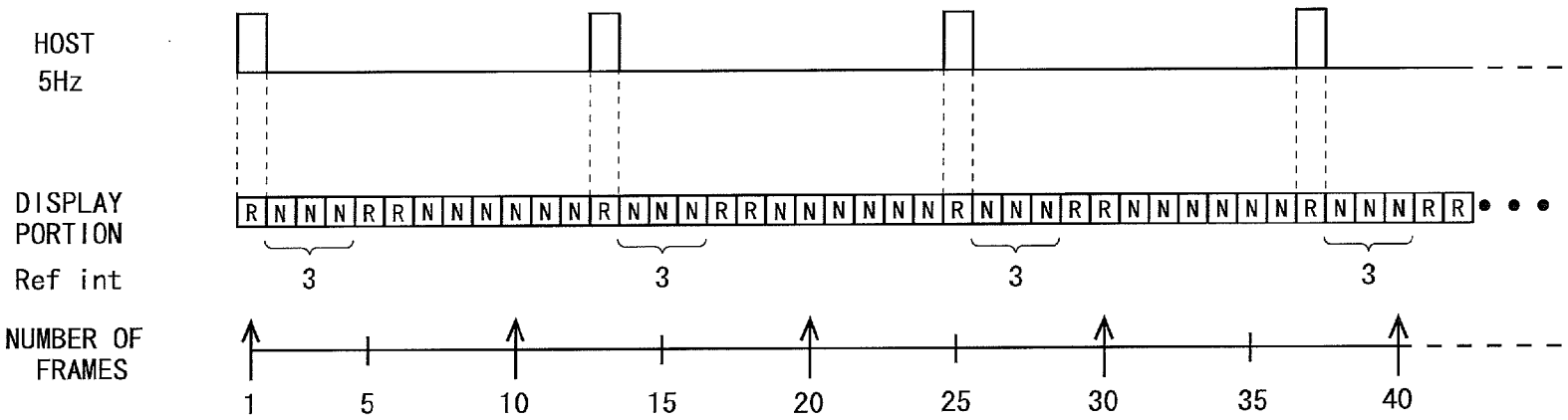
FIG. 9 is a diagram for explaining an operation, in the pause drive, of a liquid crystal display device according to a first modified example of the first embodiment shown in FIG. 8.

In the above embodiment, Ref_int has been set to 2. However, Ref_int is not restricted to 2, but may be 1, or may be an integer not smaller than 3. A first modified example is the case of setting only Ref_int to 3 in the above present embodiment. FIG. 9 is a diagram for explaining an operation, in the pause drive, of the liquid crystal display device 2 according to a first modified example of the present embodiment. In the first modified example, as shown in FIG. 9, when updated image data is transmitted, the first refresh is performed by use of this image data, and based on Ref_int, a refresh pauses just in the next three-frame period. Then, the second and third refreshes are consecutively performed, and a refresh pause is repeated until the next updated image data is transmitted. Also in this case, a refresh can be performed three times in a short period. It is to be noted that an afterimage is visually recognized when Ref_int is set excessively large, and hence Ref_int is required to be appropriately adjusted.

<2.6.2 Second Modified Example>

Figure 10:
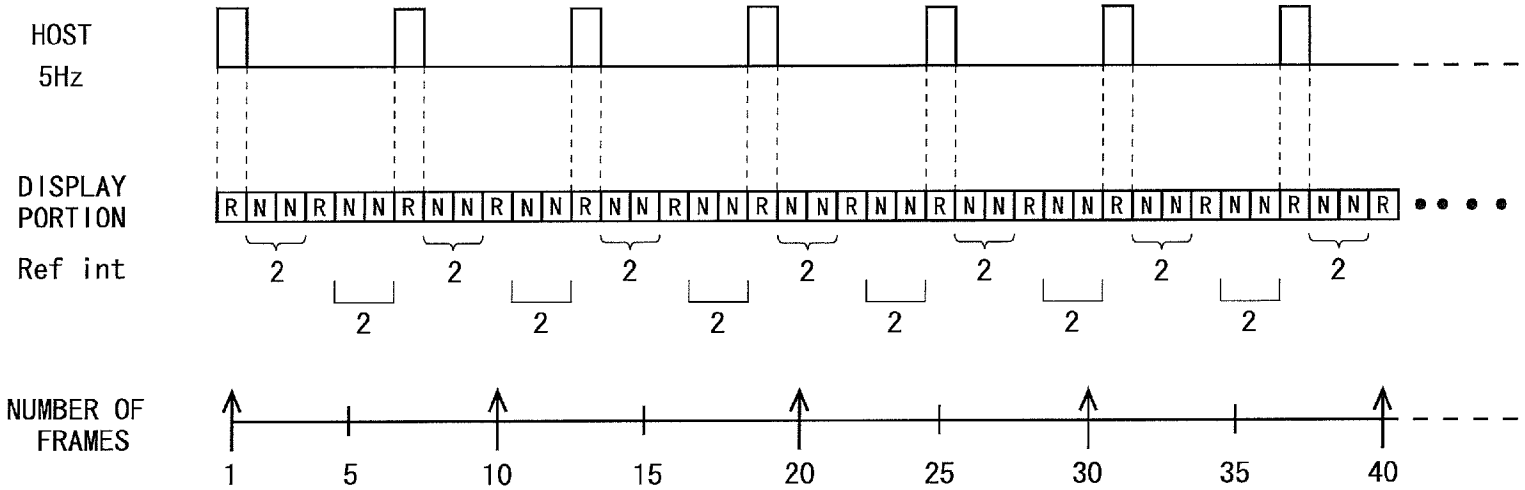
FIG. 10 is a diagram for explaining an operation, in the pause drive, of a liquid crystal display device according to a second modified example of the first embodiment shown in FIG. 8.

In the above embodiment and first modified example, the second and third refreshes have been consecutively performed. However, these refreshes are not necessarily required to be consecutively performed, but a pause period may be provided therebetween. For example, a pause period for a two-frame period may be provided between the second refresh and the third refresh. FIG. 10 is a diagram for explaining an operation, in the pause drive, of the liquid crystal display device 2 according to a second modified example of the present embodiment. In the second modified example, as shown in FIG. 10, when the refresh rate of the image data is 10 Hz, the first refresh is performed by use of the updated image data in the first frame, and a refresh pauses in the second and third frames. The second refresh is performed in the fourth frame, and a refresh pauses in the fifth and sixth frames. Next, when the third refresh is about to be performed in the seventh frame, the next updated image data is transmitted. Then, the third refresh is stopped, and the first refresh is performed by use of the updated image data. In such a manner, a refresh is performed only twice every time the image data is updated, thereby to allow reduction in power consumption of the liquid crystal display device 2. It is to be noted that providing a pause period for two frames also between the second refresh and the third refresh is similarly applicable to the case of refreshing image data at a refresh rate of not lower than 15 Hz.

<3. Second Embodiment>

Figure 11:
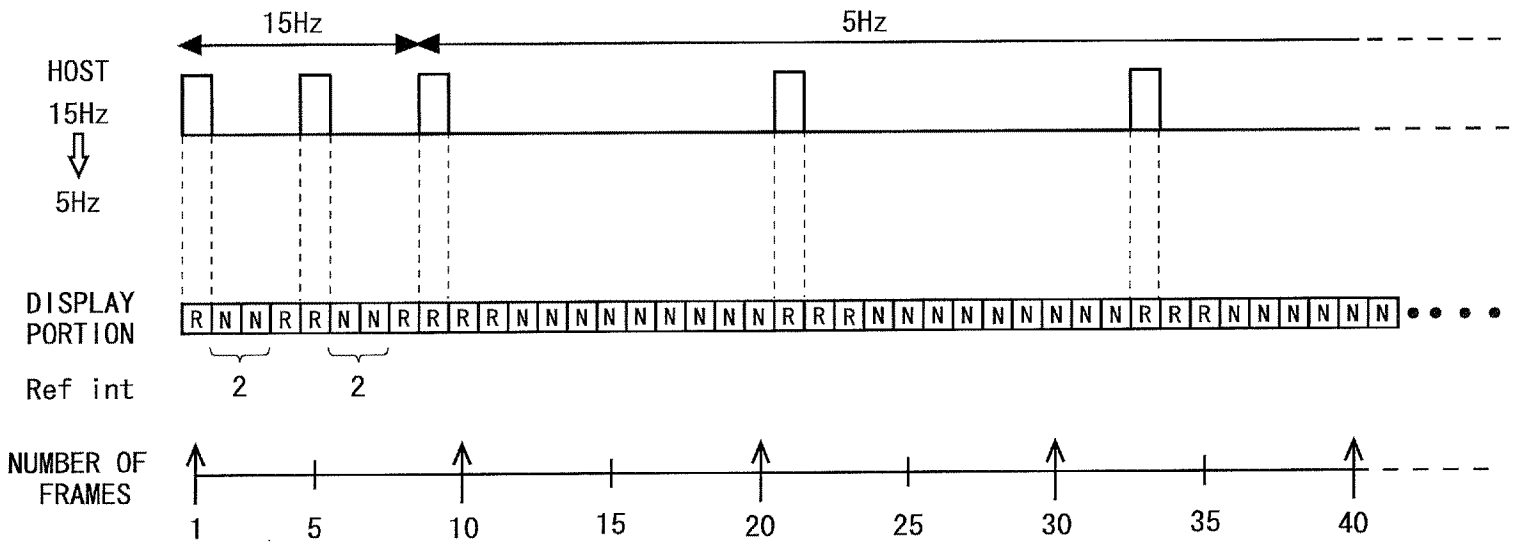
FIG. 11 is a diagram for explaining an operation, in the pause drive, of a liquid crystal display device according to a second embodiment of the present invention.

FIG. 11 is a diagram for explaining an operation, in the pause drive, of the liquid crystal display device 2 according to a second embodiment of the present invention. It is to be noted that, since the present embodiment is similar to the above first embodiment except for the operation in the pause drive, there will be omitted a block diagram showing the configuration of the liquid crystal display device 2 and the configuration of the display control circuit 200 included in the liquid crystal display device 2, and descriptions thereof.

<3.1 Operation in Pause Drive>

In the above first embodiment, updated image data is transmitted from the host 1 at a constant frame rate (e.g., 5 Hz). However, the refresh rate of the image data may be switched after the start of the pause drive. In the present embodiment, when this refresh rate is switched is assumed to be previously known.

As shown in FIG. 11, for example, it is assumed to be previously known that the refresh rate of the image data is 15 Hz in first and second transmission, but it is switched to 5 Hz in third transmission and thereafter. Then, in order to refresh image data transmitted for the first and second times, Ref_int is set to 2 as corresponding to 15 Hz. Further, in order to refresh image data transmitted for the third time and thereafter, Ref_int is set to 0 as corresponding to 5 Hz.

In this case, since Ref_int is 2, the first refresh is performed in the first frame, and a refresh pauses in the second and third frames. The second refresh is performed in the fourth frame, and when the third refresh is about to be performed in the fifth frame, the next updated image data is transmitted.

Then, the third refresh having been scheduled to be performed in the fifth frame is stopped, and the first refresh is performed by use of the updated image data. Then, a refresh pauses in the sixth and seventh frames. The second refresh is performed in the eighth frame, and when the third refresh is about to be performed in the ninth frame, the next updated image data is transmitted. Then, the third refresh having been scheduled to be performed in the ninth frame is stopped, and the first refresh is performed by use of the updated image data.

Since it is previously known that the refresh rate of the image data transmitted in the ninth frame has been changed to 5 Hz, Ref_int is reset to 0. Based on Ref_int having been reset, the second and third refreshes are respectively performed in the tenth and eleventh frames. Then, a refresh pauses from the twelfth frame to the twentieth frame.

In the twenty-first frame, since the refresh rate of the transmitted image data is 5 Hz which is the same as the refresh rate of the image data in the ninth frame, the first refresh is performed by use of this image data without changing Ref_int, and the second and third refreshes are respectively performed in the twenty-second and twenty-third frames. Then, a refresh pauses from the twenty-fourth frame to the thirty-second frame. Hereinafter, in a similar manner, the updated image data is transmitted at 5 Hz, and hence the pause drive is performed without changing Ref_int.

It should be noted that the case has been described in the above embodiment where a refresh is performed a predetermined number of times by use of the image data at the refresh rate of 15 Hz and thereafter the refresh rate of the image data is switched from 15 Hz to 5 Hz. However, the change in refresh rate is not restricted thereto, and for example, there may be a case where a change is made from 30 Hz to 1 Hz, or there may be similarly applicable a case where a reverse change is made from 5 Hz to 15 Hz or from 1 Hz to 30 Hz.

<3.2 Effect>

According to the present embodiment, since it is previously known that the refresh rate of the image data is switched during the pause drive, Ref_int is reset accordingly. Thereby, even when the refresh rate of the image data transmitted from the host 1 is switched during the pause drive, it is possible to make an afterimage visually unrecognizable during the pause drive while reducing the power consumption of the liquid crystal display device 2.

<3.3 Modified Example>

In the above embodiment, since the timing for switching of the refresh rate of the image data is previously known, the setting of Ref_int has been changed accordingly. However, there may be a case where the timing for switching of the refresh rate of the image data is not previously known but it is abruptly switched.

<3.3.1 First Modified Example>

Figure 12:
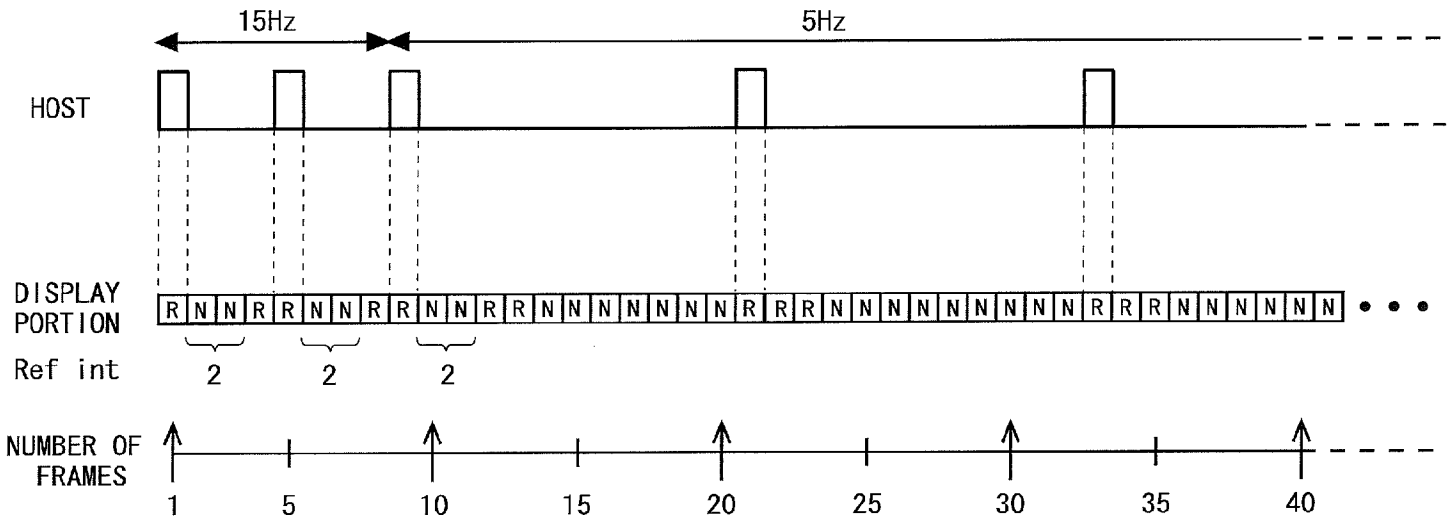
FIG. 12 is a diagram for explaining an operation, in the pause drive, of a liquid crystal display device according to a first modified example of the second embodiment shown in FIG. 11.

FIG. 12 is a diagram for explaining an operation, in the pause drive, of the liquid crystal display device 2 according to a first modified example of the present embodiment. In the first modified example, as shown in FIG. 12, the refresh rate of the image data is 15 Hz in first and second transmission, but it is switched to 5 Hz in third transmission. However, at the point in time of switching to 5 Hz, the display control circuit 200 cannot determine whether the refresh rate of the image data is 15 Hz or it has been switched to 5 Hz.

Since the pause drive in the case of the updated image data being transmitted at 15 Hz is the same as in the case shown in FIG. 11, a description from the first frame to the eighth frame will be omitted, and a description will begin with an operation in the ninth frame. In the ninth frame, the refresh rate of the transmitted image data has been switched from 15 Hz to 5 Hz, but at this point in time, the display control circuit 200 cannot recognize that the refresh rate has been switched. For this reason, Ref_int at this time remains 2. However, since the refresh rate has been switched to 5 Hz, it is not the thirteenth frame but the twenty-first frame where the next updated image data is transmitted. As a result, a refresh is performed by use of the updated image data in the ninth frame and a refresh pauses in the tenth and eleventh frames. Next, the second and third refreshes are performed in the twelfth and thirteenth frames, and a refresh pauses from the fourteenth to twentieth frame.

By receiving an updated image data in the twenty-first frame, the display control circuit 200 recognizes that the update cycle has been switched to 5 Hz, and changes the setting of Ref_int to 0. Therefore, the first refresh is performed in the twenty-first frame, and the second and third refreshes are respectively performed in the twenty-second and twenty-third frames. Then, a refresh pauses from the twenty-fourth frame to the thirty-second frame. Hereinafter, in a similar manner, the updated image data is transmitted at 5 Hz, and hence Ref_int remains 0.

As thus described, when it is not previously known that the refresh rate of the image data would be switched, the display control circuit 200 cannot recognize the switching immediately thereafter, and hence Ref_int is not immediately changed accordingly. However, when the image data is next transmitted at the same refresh rate, Ref_int is reset accordingly. For this reason, the timing for resetting of Ref_int is delayed from the timing for switching of the refresh rate. However, even when the refresh rate of the image data transmitted from the host 1 is abruptly switched, resetting Ref_int can reliably make an afterimage during the pause drive visually unrecognizable regardless of the refresh rate.

<3.3.2 Second Modified Example>

Figure 13:
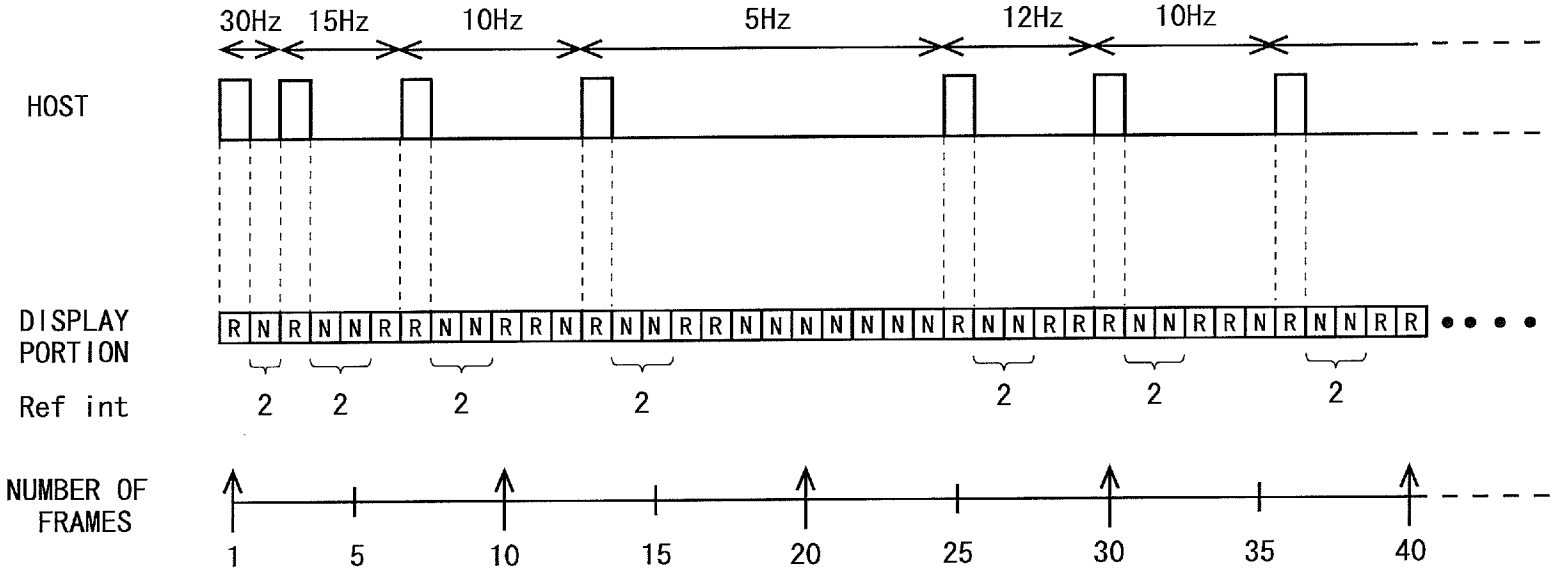
FIG. 13 is a diagram for explaining an operation, in the pause drive, of a liquid crystal display device according to a second modified example of the second embodiment shown in FIG. 11.

The refresh rate of the image data may be switched one after another among a plurality of refresh rates, such as 30 Hz, 15 Hz, 10 Hz and 5 Hz. FIG. 13 is a diagram for explaining an operation, in the pause drive, of the liquid crystal display device 2 according to a second modified example of the present embodiment. In the second modified example, as shown in FIG. 13, Ref_int is set so as to be constantly 2 such that, even when the refresh rate is sequentially switched from 30 Hz, Ref_int is not changed accordingly. Thereby, only one register 222 may be provided in the command register 220 so as to store Ref_int, thereby allowing reduction in manufacturing cost of the display control circuit 200. In addition, in order to make an afterimage visually unrecognizable by promptly performing a total of three times of refreshes, any one of 1 to 3 is preferably set as Ref_int, but this is not restrictive.

<4. Third Embodiment>

Figure 14:
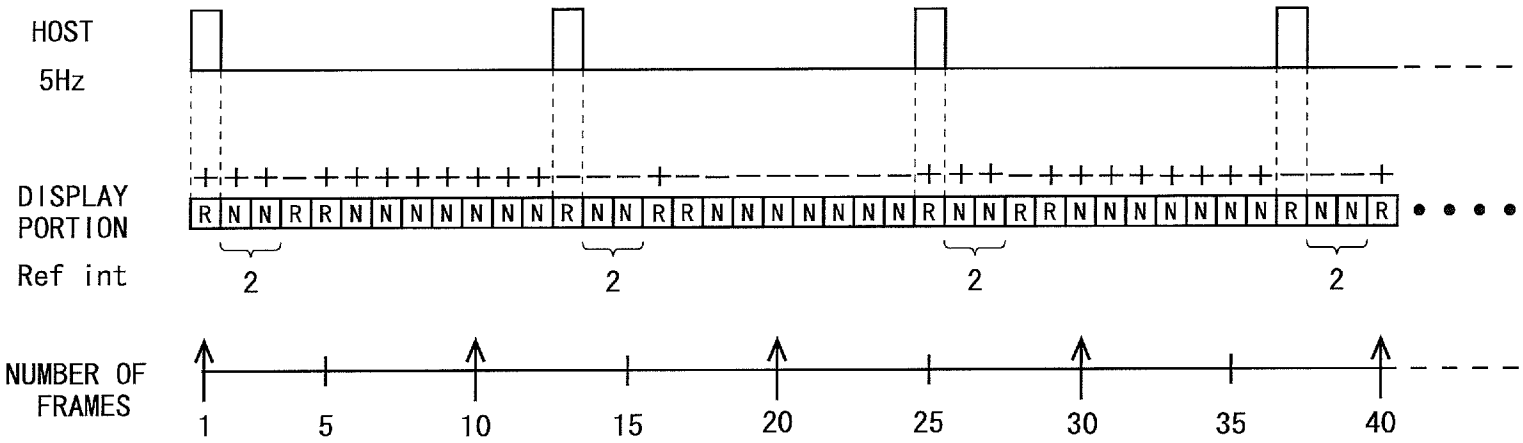
FIG. 14 is a diagram for explaining an operation, in the pause drive, of a liquid crystal display device according to a third embodiment of the present invention.

FIG. 14 is a diagram for explaining an operation, in the pause drive, of the liquid crystal display device 2 according to a third embodiment of the present invention. It is to be noted that, since the present embodiment is similar to the above first embodiment except for the operation in the pause drive, there will be omitted a block diagram showing the configuration of the liquid crystal display device 2 and the configuration of the display control circuit 200 included in the liquid crystal display device 2, and descriptions thereof.

<4.1 Operation in Pause Drive>

Throughout the pause drive period, when a balance between positive polarity and negative polarity of the applied voltage of the liquid crystal capacitance Ccl is not considered, the time when a voltage in a specific direction is applied to the liquid crystal layer becomes long, causing the deterioration in liquid crystal layer to tend to be accelerated. Accordingly, in the present embodiment, an afterimage during the pause drive is made visually unrecognizable, and further, deterioration in liquid crystal layer is suppressed.

In the present embodiment, polarity reversal drive (i.e., Alternating Current (AC) drive) is performed in order to suppress the deterioration in liquid crystal layer. Under each refresh frame and non-refresh frame shown in FIG. 14, there is shown polarity of a voltage that is applied at the refresh time performed in the frame. Specifically, "+" indicates that the voltage which is applied to the pixel electrode 112 is higher than the voltage which is applied to the common electrode 113. "−" indicates that the voltage which is applied to the pixel electrode 112 is lower than the voltage which is applied to the common electrode 113. Hereinafter, a refresh frame for applying a higher voltage to the pixel electrode 112 than the common electrode 113 to perform a refresh will be referred to as a "positive polarity refresh frame", and a refresh frame for applying a lower voltage to the pixel electrode 112 than the common electrode 113 to perform a refresh will be referred to as a "negative polarity refresh frame".

As shown in FIG. 14, it is assumed that the updated image data is transmitted at 5 Hz from the host 1, and that Ref_int is 2. In the first frame, when updated image data is transmitted from the host 1, the first refresh is performed. With this refresh being a positive polarity refresh, the first frame becomes a positive polarity refresh frame. Since Ref_int has been set to 2, a refresh pauses in the second and third frames. However, since the same positive polarity voltage as at the time of the first refresh is held, the second and third frames also become positive polarity non-refresh frames. The second refresh is performed in the fourth frame. The polarity is reversed every time a refresh is performed, and hence this refresh is a negative polarity refresh. Further, the third refresh is performed in the fifth frame. This refresh is a positive polarity refresh. Subsequently, a refresh pauses in each frame from the sixth frame to the twelfth frame. Also at this time, since the same positive polarity voltage as at the time of the third refresh is held, the sixteenth to twelfth frames also become positive polarity non-refresh frames. In this case, the number of positive polarity frames from the first frame to the twentieth frame is 11 and the number of negative polarity frames is one.

In the thirteenth frame, when updated image data is transmitted from the host 1, the fourth refresh is performed. With this refresh being a negative polarity refresh, the thirteenth frame becomes a negative polarity refresh frame.

Since Ref_int has been set to 2, a refresh pauses in the fourteenth and fifteenth frames. However, since the same negative polarity voltage as at the time of the thirteenth refresh is held, the fourteenth and fifteenth frames also become negative polarity non-refresh frames. The fifth refresh is performed in the sixteenth frame. The polarity is reversed every time a refresh is performed, and hence this refresh is a positive polarity refresh. Further, the sixth refresh is performed in the seventeenth frame. This refresh is a negative polarity refresh. Subsequently, a refresh pauses in each frame from the eighteenth frame to the twenty-fourth frame. At this time, since the same negative polarity voltage as at the time of the sixth refresh is held, the eighteenth to twenty-fourth frames also become negative polarity non-refresh frames. In this case, the number of positive polarity frames from the thirteenth frame to the twenty-fourth frame is one and the number of negative polarity frames is 11.

As a result, the number of positive polarity frames and the number of negative polarity frames from the first frame to the twenty-fourth frame are both 12. As thus described, a refresh is performed such that the number of positive polarity frames and the number of negative polarity frames are in the same proportion.

In addition, although the case of the refresh rate being 5 Hz has been described in the present embodiment, it is also possible in the first and second embodiments and the modified examples thereof to perform a refresh such that the number of positive polarity frames and the number of negative polarity frames are in the same proportion.

<4.2 Effect>

According to the present embodiment, a similar effect to that in the case of the first embodiment is achieved, and further, the number of positive polarity frames and the number of negative polarity frames can be set to be in the same proportion. As thus described, with the AC drive performed on the liquid crystal layer, the time for application of a voltage in a specific direction to the liquid crystal layer does not take long, and the deterioration in liquid crystal layer can be suppressed.

<4.3 First Modified Example>

Figure 15:
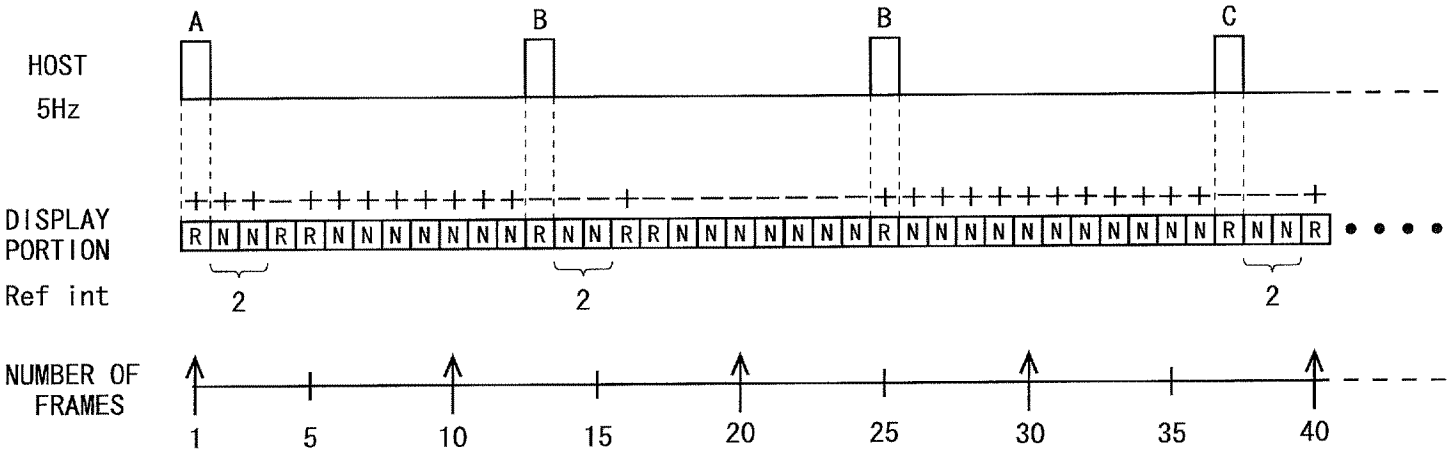
FIG. 15 is a diagram for explaining an operation, in the pause drive, of a liquid crystal display device according to a first modified example of the third embodiment shown in FIG. 14.

FIG. 15 is a diagram for explaining an operation, in the pause drive, of the liquid crystal display device according to a first modified example of the present embodiment. When image data transmitted from the host 1 has not been updated, namely when the same image data as the image data transmitted immediately before is transmitted, the problem of an afterimage being visually recognized in the pause period does not occur. Then, a refresh in such a case will be described.

Refreshes and non-refreshes from the first frame to the twenty-fourth frame are the same as in the foregoing case of FIG. 14, and hence a description thereof will be omitted. In addition, it is assumed that image data transmitted from the host 1 in the first frame is data of an image A, and that image data transmitted in the thirteenth frame is data of an image B.

Next, in the twenty-fifth frame, the data of the image B which is the same as the image data transmitted in the thirteenth frame is transmitted. Then, the seventh refresh is performed in the twenty-fifth frame. With this refresh being a positive polarity refresh, the twenty-fifth frame becomes a positive polarity refresh frame. Since Ref_int has been set to 2, a refresh pauses in the twenty-sixth and twenty-seventh frames. However, since the same positive polarity voltage as at the time of the seventh refresh is held, the twenty-sixth and twenty-seventh frames also become positive polarity non-refresh frames.

The image data transmitted in the twenty-fifth frame is the data of the image B which is the same as the image data transmitted in the thirteenth frame, and hence an afterimage is not visually recognized in the pause period. For this reason, a refresh pauses also in the twenty-eighth and twenty-ninth frames. As a result, the twenty-sixth frame to the thirty-sixth frame all become positive polarity frames.

Next, in the thirty-seventh frame, data of an image C is transmitted differently from the image data transmitted in the twenty-fifth frame. Then, refreshes and non-refreshes are performed from the thirty-seventh frame to the forty-eighth frame as in the foregoing case of the thirteenth frame to the twenty-fourth frame.

As thus described, when the same image data as the image data transmitted immediately before is transmitted from the host 1, even when the number of times of refreshes is decreased, an afterimage is not visually recognized. Hence it is possible to reduce the power consumption of the liquid crystal display device 2.

<4.4 Second Modified Example>

A liquid crystal display device provided with the display control circuit 200 of the video mode RAM capture shown in FIG. 6 and a liquid crystal display device provided with the display control circuit 200 of the command mode RAM write shown in FIG. 7 can store image data, transmitted from the host 1, in the frame memory 280. For this reason, even when image data is not transmitted from the host 1, a refresh can be performed by reading the image data stored in the frame memory 280.

Figure 16:
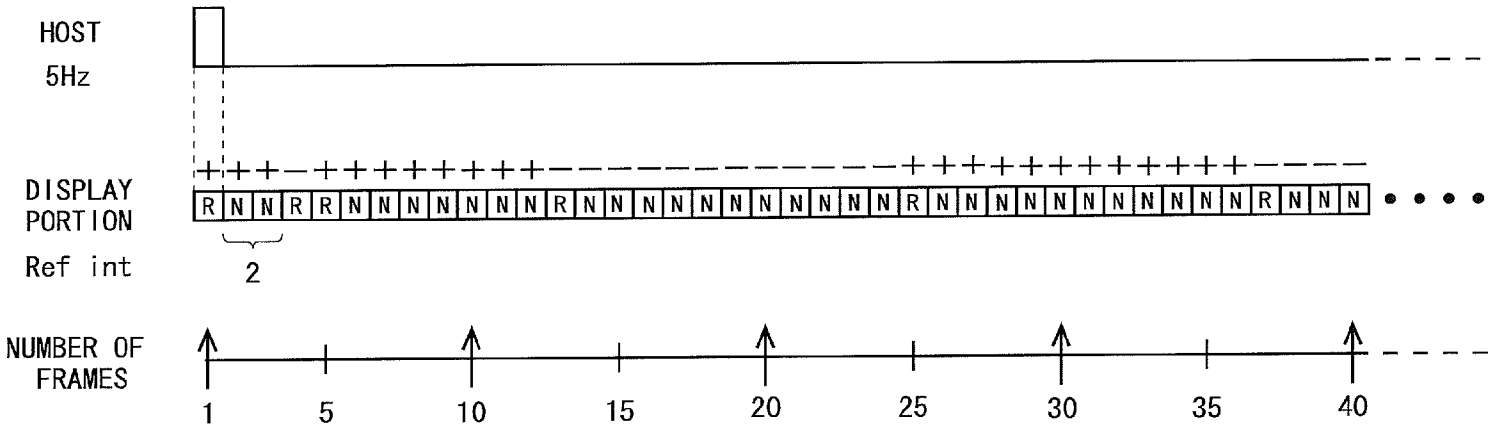
FIG. 16 is a diagram for explaining an operation, in the pause drive, of a liquid crystal display device according to a second modified example of the third embodiment shown in FIG. 14.
Figure 17:
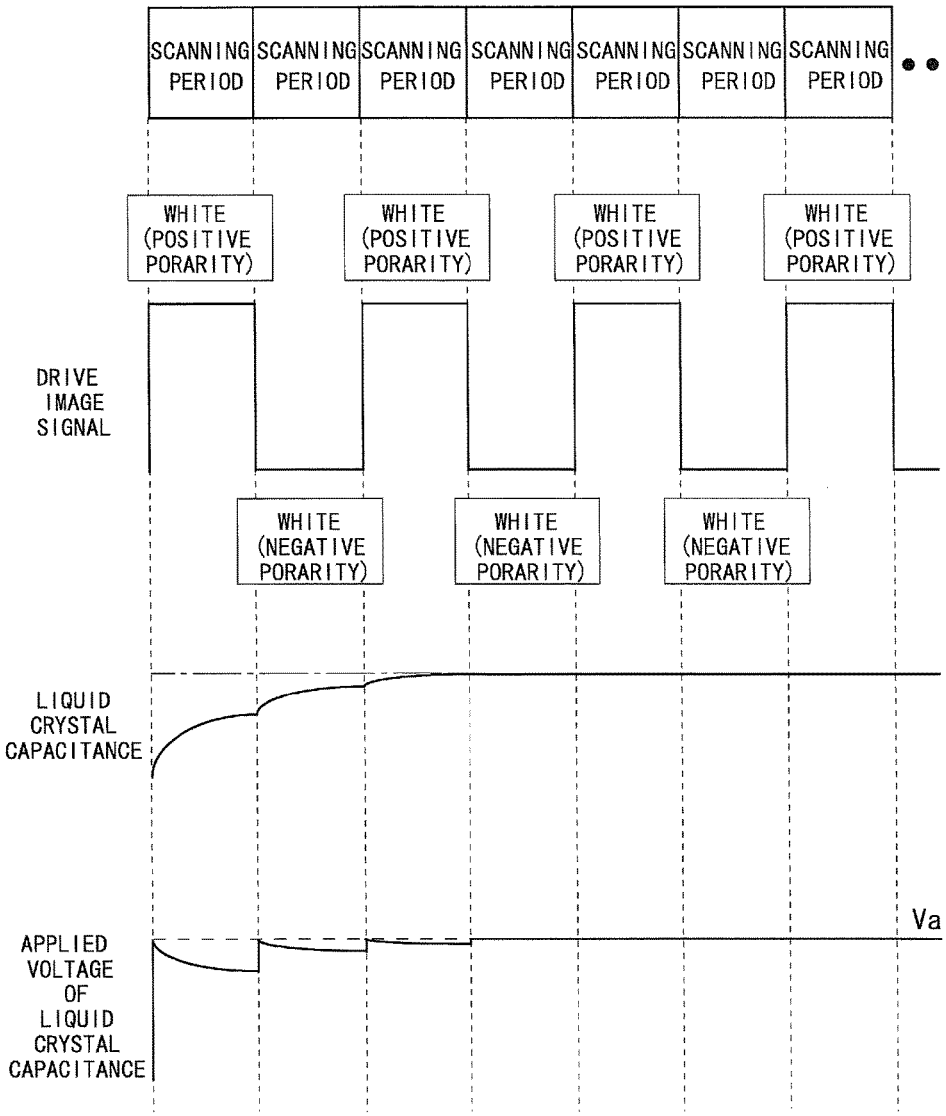
FIG. 17 PRIOR ART
FIG. 17 is one example of a timing chart showing normal drive in a conventional liquid crystal display device.
Figure 18:
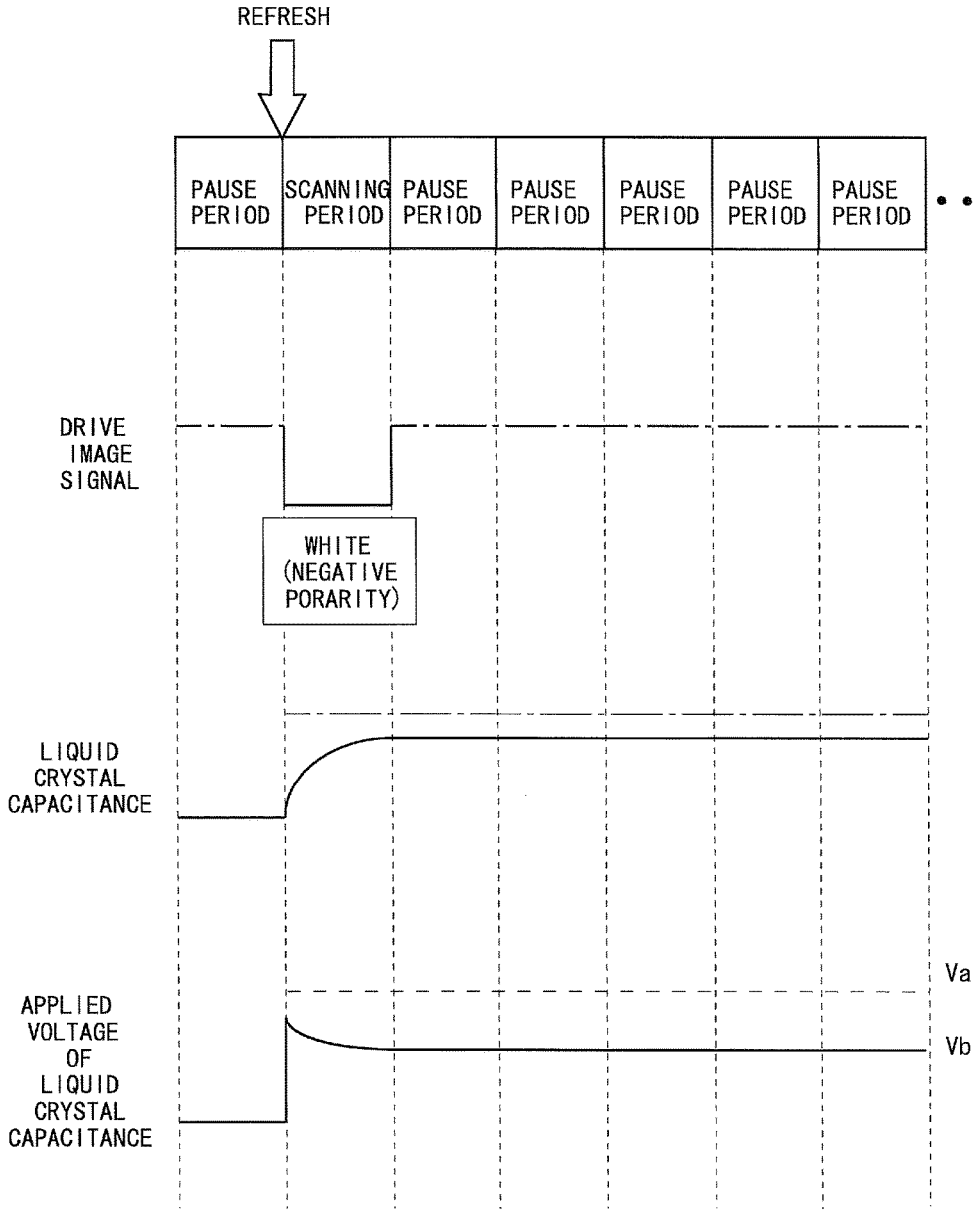
FIG. 18 PRIOR ART
FIG. 18 is one example of a timing chart showing first pause drive in the conventional liquid crystal display device.

FIG. 16 is a diagram for explaining an operation, in the pause drive, of the liquid crystal display device according to a second modified example of the present embodiment. As shown in FIG. 16, image data is transmitted only in the first frame. However, in the thirteenth frame, the twenty-fifth frame, and the thirty-seventh frame, a refresh is performed by reading the image data stored into the frame memory 280 in the first frame. In this case, since the image data read from the frame memory 280 is the same data as the image data transmitted in the first frame, even when a refresh is performed in each of the thirteenth frame, the twenty-fifth frame, and the thirty-seventh frame, an afterimage is not visually recognized. Hence it is not necessary to further perform a refresh twice after a refresh is performed in each of the frames. Therefore, in the twenty-fifth frame to the thirty-sixth frame, a positive polarity refresh is performed just once, followed by a positive polarity non-refresh eleven times, as in the case of the twenty-fifth frame to the thirty-sixth frame shown in FIG. 16. Further, from the thirteenth frame to the twenty-fourth frame and from the thirty-seventh frame to the forty-eighth frame, a negative polarity refresh is performed just once each, followed by a negative polarity non-refresh eleven times.

As thus described, in the case of performing a refresh by use of the image data read from the frame memory 280, even when the number of times of refreshes is decreased, an afterimage is not visually recognized. Hence it is possible to reduce the power consumption of the liquid crystal display device 2.

<5. Others>

In each of the above embodiments and modified example, the case of reversing the polarity in every one refresh frame has been described, but the manner in which the polarity is reversed is not restricted thereto, and for example, the polarity may be reversed in every two refresh frames or three refresh frames.

The present invention is applicable to a liquid crystal display device that displays an image by pause drive.

DESCRIPTION OF REFERENCE CHARACTERS

1: HOST
2: LIQUID CRYSTAL DISPLAY DEVICE
100: DISPLAY PORTION
110: PIXEL FORMATION PORTION
111: TFT (THIN-FILM TRANSISTOR)
200: DISPLAY CONTROL CIRCUIT
220: COMMAND REGISTER
222: REGISTER
230: TIMING GENERATOR
240: LATCH CIRCUIT
280: FRAME MEMORY (RAM)
300: SIGNAL LINE DRIVE CIRCUIT
400: SCANNING LINE DRIVE CIRCUIT
SL: SIGNAL LINE
GL: SCANNING LINE

The invention claimed is:

1. A liquid crystal display device which performs pause driving at a predetermined refresh rate, the liquid crystal display device comprising:

a display including a plurality of pixel formation portions;

a driver that drives the display; and a display controller that controls the driver based on data received from an outside, wherein when image data included in the data is updated, the display controller performs a refresh once using the updated image data, and then pauses refreshing only in a pause period that is decided in accordance with a refresh rate of the image data, after the end of the pause period, the display controller performs additional refreshing using the image data as the updated data and the additional refreshing includes refreshing twice after the end of the pause period.

2. The liquid crystal display device according to claim 1, wherein the additional refreshing includes two consecutively performed refreshing operations.

3. The liquid crystal display device according to claim 1, wherein the additional refreshing includes two refreshing operations performed with a period for making a refresh pause therebetween.

4. The liquid crystal display device according to claim 1, wherein, when the display controller receives new data from the outside, the data including image data for updating a screen of the display at the time of performing a refresh or making a refresh pause, the display controller stops the refresh or the refresh pause, performs a refresh once by use of the image data included in the new data, then makes a refresh pause just in the pause period that is decided in accordance with a refresh rate of the image data, and performs a refresh at least once or more by use of the same image data as the updated image data after the end of the pause period.

5. A liquid crystal display device which performs pause driving at a predetermined refresh rate, the liquid crystal display device comprising:

a display including, a plurality of pixel formation portions;

a driver that drives the display; and a display controller that controls the driver based on data received from an outside, wherein, when image data included in the data is updated, the display controller performs a refresh once using the updated image data, and then pauses refreshing only in a pause period that is decided in accordance with a refresh rate of the image data, after the end of the pause period, the display controller performs additional refreshing using the same image data as the updated image data, when the display controller receives new data from the outside, the data including image data for updating a screen of the display at the time of performing a refresh or making a refresh pause, the display controller stops the refresh or the refresh pause, performs a refresh once by use of the image data included in the new data, then makes a refresh pause just in the pause period that is decided in accordance with a refresh rate of the image data, and performs a refresh at least once or more by use of the same image data as the updated image data after the end of the pause period, and when the image data included in the data received from the outside has not been updated, the display controller makes a refresh pause that is performed after the end of the pause period.

6. The liquid crystal display device according to claim 1, wherein the pixel formation portion includes a thin-film transistor including a control terminal connected to a scanning line in the display, a first conduction terminal connected to a signal line in the display, a second conduction terminal connected to a pixel electrode in the display, which is to be applied with a voltage in accordance with an image to be displayed, and a channel layer made of an oxide semiconductor.

7. The liquid crystal display device according to claim 6, wherein the oxide semiconductor is InGaZnOx mainly composed of indium (In), gallium (Ga), zinc (Zn) and oxygen (O).

8. A method for driving a liquid crystal display device which includes a display including a plurality of pixel formation portions, a driver that drives the display, and a display controller that controls the driver based on data received from an outside, the device performing pause drive at a predetermined refresh rate, the method comprising the steps of:

performing a refresh once using updated image data when image data included in the data is updated;

pausing refreshing only in a pause period that is decided in accordance with a refresh rate of the image data; and performing additional refreshing using the same image data as the updated image data after the end of the pause period; wherein the additional refreshing includes refreshing twice after the end of the pause period.

* * * * *